US010836517B2

(12) United States Patent
Ponti

(10) Patent No.: US 10,836,517 B2
(45) Date of Patent: Nov. 17, 2020

(54) CLOSING STATION FOR CLOSING A CARDBOARD BOX FORMED ABOUT AN ARTICLE AND MACHINE FOR PACKING AN ARTICLE INTERNALLY OF A CARDBOARD BOX OBTAINED FROM A CARDBOARD BLANK

(71) Applicant: F.L. AUTO S.R.L., Rome (IT)

(72) Inventor: Giuseppe Ponti, Cerbara-Citta' di Castello (IT)

(73) Assignee: F.L. AUTO S.R.L., Rome (IT)

( * ) Notice: Subject to any disclaimer, the term of this patent is extended or adjusted under 35 U.S.C. 154(b) by 81 days.

(21) Appl. No.: 16/303,407

(22) PCT Filed: May 18, 2017

(86) PCT No.: PCT/IB2017/052941
§ 371 (c)(1),
(2) Date: Nov. 20, 2018

(87) PCT Pub. No.: WO2017/203401
PCT Pub. Date: Nov. 30, 2017

(65) Prior Publication Data

US 2020/0031506 A1 Jan. 30, 2020

(30) Foreign Application Priority Data

May 24, 2016 (IT) ..... 102016000053190

(51) Int. Cl.
*B65B 5/02* (2006.01)
*B31B 50/62* (2017.01)
(Continued)

(52) U.S. Cl.
CPC ..... *B65B 5/024* (2013.01); *B31B 50/622* (2017.08); *B65B 7/20* (2013.01); *B65B 11/004* (2013.01);
(Continued)

(58) Field of Classification Search
CPC .. B65B 5/024; B65B 7/20; B65B 7/22; B65B 7/26; B65B 11/004; B65B 11/06;
(Continued)

(56) References Cited

U.S. PATENT DOCUMENTS 2,718,106 A * 9/1955 Hooffstetter et al. .. B65B 43/52 53/131.2
3,137,112 A * 6/1964 Kulleseid ..... B65B 7/20 53/377.3

(Continued)

FOREIGN PATENT DOCUMENTS

DE 2123991 A1 * 8/1972 ..... B65B 5/024
WO WO 2014/033624 A1 3/2014

*Primary Examiner* — Stephen F. Gerrity
(74) *Attorney, Agent, or Firm* — R. Neil Sudol; Henry D. Coleman

(57) ABSTRACT

A conveyor receives a cardboard box formed about an article, with a first lateral flank uncovered. An inlet receives the cardboard box with the first lateral closing wall coplanar with a base wall, a second lateral closing box wall folded to cover a second lateral article flank, a third lateral closing box wall folded to cover a third lateral article flank, a fourth lateral closing box wall folded to cover a fourth lateral article flank, and an upper closing box wall folded to cover an upper article face. An arrest stops the box, a first folding component rotates and folds the first lateral closing box wall to cover the first lateral article flank, and second folding component rotates a closing tab (AC), hinged to the upper closing wall to fold and bring a closing tab against the first lateral closing wall for closing the cardboard box.

11 Claims, 17 Drawing Sheets

(51) Int. Cl.

| | |
|---|---|
| ***B65B 49/08*** | (2006.01) |
| ***B65D 5/10*** | (2006.01) |
| ***B65B 11/00*** | (2006.01) |
| ***B65B 7/20*** | (2006.01) |
| ***B65B 51/02*** | (2006.01) |

(52) U.S. Cl.
CPC ..... *B65B 49/08* (2013.01); *B65B 51/02* (2013.01); *B65D 5/10* (2013.01)

(58) Field of Classification Search
CPC ..... B65B 11/08; B65B 11/105; B65B 11/12; B65B 49/00; B65B 49/08; B65B 51/02; B65B 51/026
USPC ..... 53/203, 209, 383.1, 376.4, 376.5
See application file for complete search history.

(56) References Cited

U.S. PATENT DOCUMENTS

| | | | | |
|---|---|---|---|---|
| 3,405,503 | A | 10/1968 | Mizelle et al. | |
| 5,148,654 | A * | 9/1992 | Kisters | B65B 11/004 53/462 |
| 6,357,212 | B1 * | 3/2002 | Salm et al. | B65B 11/004 53/558 |
| 7,322,171 | B2 * | 1/2008 | Bonnain et al. | B65B 5/024 53/209 |
| 2012/0079796 | A1 * | 4/2012 | Kim et al. | B65B 5/024 53/473 |
| 2015/0360433 | A1 | 12/2015 | Feijen | |

* cited by examiner

CLOSING STATION FOR CLOSING A CARDBOARD BOX FORMED ABOUT AN ARTICLE AND MACHINE FOR PACKING AN ARTICLE INTERNALLY OF A CARDBOARD BOX OBTAINED FROM A CARDBOARD BLANK

FIELD OF THE INVENTION

The present invention relates to the particular technical sector concerning packaging and packing of articles internally of a cardboard box.

In particular the present invention relates to a closing station for closing a cardboard box formed about an article and a machine for realising a packaging of an article internally of a cardboard box obtained from the cardboard blank.

DESCRIPTION OF THE PRIOR ART

In the sector of logistics and goods dispatching, the need to pack and package the goods to be dispatched is known, in relative cardboard boxes, with the purpose of protecting and safeguarding them.

The Applicant has realised a special cardboard blank for packaging articles, usable for forming a cardboard box with reinforced walls for packing and packaging an article internally thereof, so as to give a special protection and resistance against impacts, and the Applicant also set up special operating procedures for obtaining and realising, from a cardboard sheet, on the basis of the effective dimensions of the article to be packed, the relative cardboard blank and enveloping it about the article so as to package it internally of a box. The Applicant is the owner of Italian patent application no. 1 0201 500001 4902 of 13 May 2015 in which the special shape of a cardboard blank for packaging utilisable for the packaging of articles is described.

The cardboard blank (C) of this patent application is illustrated in FIG. 1 and has the peculiarity of comprising parts that are foldable onto other parts so as to identify reinforced walls' utilisable for enveloping the article to be packed and to form a box with the packaged article inside.

In particular, the cardboard blank (C) has a quadrilateral shape, which can be for example square or preferably rectangular, with two transversal edges (B1, B2) and two longitudinal edges (BL), and comprises, at a first transversal edge (B1) and a second transversal edge (B2), two longitudinal score lines (L1, L2), parallel to one another: the two longitudinal score lines (L1, L2) identify, in the cardboard sheet, a central sector (SC) and two lateral sectors (SL1, SL2). Usually, the articles to be packed and dispatched have, or are predisposed in, containers having a parallelepiped shape, with a quadrangular or rectangular base.

The two longitudinal score lines (L1, L2) are realised on the cardboard blank (C) distanced from one another on the basis of the effective dimensions of the base of the article to be packed, for example on the basis of the length (L) of the base of the article.

The cardboard blank (C) further comprises four transversal score lines (T1, T2, T3, T4), parallel to one another and such as to identify, on the central sector (SC) of the cardboard blank (C) and between the two transversal edges (B1, B2), five portions (P1, P2, P3, P4, P5).

The four transversal score lines (T1, T2, T3, T4) are made so as to be distanced from one another as a function of the effective dimensions of the article to be packed, in particular on the basis of the width (I) of the base of the article, the width (L*) of the upper face and the height (H) of the flanks of the article.

In detail, starting from a first transversal edge (B1) of the cardboard blank (C);

- the first transversal score line (T1) and the second transversal score line (T2) are realised so as to be distant from one another by a distance (I) corresponding to the width of the base of the article to be packed, in this way, in the central sector (SC) of the cardboard blank (C) a first portion (P1) is identified that has dimensions corresponding to the base of the article to be packed, and on which first portion (P1) the article can be rested during the packaging operations;
- the first transversal score line (T1) is realised at a distance from the first transversal edge (B1) of the cardboard blank (C) such that it corresponds to the height (H) of a first lateral flank of the article, and in this way, in the central sector (SC) of the cardboard box (C) a second portion (P2) is identified between the first transversal edge (B1) and the first portion (P1), of dimensions corresponding to a first lateral flank of the article to be packed, and destined to cover the first flank of the article during the packaging operations once folded about the first transversal score line (T1);
- the third transversal score line (T3) is realised so as to be distant from the second transversal score line (T2) by a distance corresponding to the height (H) of a second flank of the article, parallel and opposite the first flank; in this way, in the central sector (SC) of the cardboard blank (C) a third portion (P3) is defined, adjacent to the first portion (P1) and on the opposite side to the second portion (P2), having dimensions corresponding to the second lateral flank of the article to be packed, and destined to cover the second flank during the packaging operations once folded about the second transversal score line (T2);
- the fourth transversal score line (T4) is realised so as to be distant from the third transversal score line (T3) by a distance corresponding to the width (L*) of the upper face of the article to be packed, in this way, in the central sector (SC) of the cardboard blank (C), a fourth portion (P4) is defined, adjacent to the third portion (P3), having dimensions corresponding to the upper face of the article to be packed, and destined to cover the upper flank once the third portion (P3) has been folded about the second transversal score line (T2) in order to cover the second flank of the article, and the fourth portion (P4) has been folded about the third transversal score line (T3).

The cardboard blank (C) further comprises, again in the central sector (SC), a fifth portion (P5), adjacent to the fourth portion (P4) and hinged thereto by means of the fourth transversal score line (T4), which constitutes a closing/opening tab (AC) of the box that will be obtained from the cardboard blank (C), and which is destined to be glued to the second portion (P2) of the cardboard blank (C), once the second portion (P2) has been folded to envelop the first flank of the article and the third portion (P3) and the fourth portion (P4) have been folded respectively to envelop the second flank of the article and the upper face of the article: the tab (AC) will enable a facilitated opening of the cardboard box for unpacking the article.

The cardboard blank (C) further comprises, for each of the two lateral sectors (SL1, SL2), four transversal cuts (11, 12, 13, 14) which extend from the longitudinal edges (BL) of the cardboard blank (C) up to arriving at the two longitudinal score lines (L1, L2), and which are made at the four transversal score lines (T1, T2, T3, T4).

In this way, in the two lateral sectors (SL1, SL2) of the cardboard blank, the cardboard blank (C) comprises:

- between the first transversal edge (B1) of the cardboard blank (C) and the transversal cuts (I1) made at the first transversal score line (T1): a first reinforcing flap (R1), at a first end of the second portion (P2), and a second reinforcing flap (R2) at a second end of the second portion (P2);
- between the transversal cuts (I2) realised at the second transversal score line (T2) and the transversal cuts (I3) realised at the third transversal score line (T3): a third reinforcing flap (R3) at a first end of the third portion (P3), and a fourth reinforcing flap (R4) at a second end of the third portion (P3);
- between the first transversal cuts (I1) realised at the first transversal score line (T1) and the transversal cuts (I2) realised at the second transversal score line (T2), a first lateral enveloping flap (A1) at a first end of the first portion (P1), and a second lateral enveloping flap (A2), at a second end of the first portion (P1);
- between the transversal cuts (I3) made at the third transversal score line (T3) and the transversal cuts (I4) made at the fourth transversal score line (T4), a fifth reinforcing flap (R5) hinged to a first end of the fourth portion (P4), and a sixth reinforcing flap (R6) at a second end of the fourth portion (P4).

With this particular conformation, the cardboard blank. (C), before the operations of packaging an article internally thereof, enables the forming of reinforced walls for enveloping corresponding lateral walls/flanks of the article. In fact, the first reinforcing flap (R1) is foldable on the second portion (P2) about the first longitudinal score line (L1), while the second reinforcing flap (R2) is in turn foldable on the second portion (P2) about the second longitudinal score line (L2) so as to at least partly superpose on the first reinforcing flap (R1): in this way the second portion (P2) of the central sector (SC) of the cardboard blank, with the first reinforcing flap (R1) and second reinforcing flap (R2) folded thereon and at least partly superposed, constitutes a first lateral closing wall (C1) which is foldable about the first transversal score line (T1) for covering the first lateral flank of the article to be packed (see for example FIGS. 1A, 1B).

The third reinforcing flap (R3) is foldable on the third portion (P3) about the first longitudinal score line (L1), while in turn the fourth reinforcing flap (R4) is foldable on the third portion (P3) about the second longitudinal score line (L2) so as to at least partly superpose on the third reinforcing flap (R3): in this way the third portion (P3) of the central sector (SC) of the cardboard blank (C), with the third reinforcing flap (R3) and fourth reinforcing flap (R4) folded thereon and at least partly superposed, constitutes a second lateral closing wall (C2) which is foldable about the second transversal score line (T2) for covering the second lateral flank, opposite the first flank, of the article to be packed (see for example FIGS. 1A, 1B, 1C).

The fifth reinforcing flap (R5) is foldable on the fourth portion (P4) About the first longitudinal score line (L1), while the sixth reinforcing flap (R6) is in turn foldable on the fourth portion (P4) about the second longitudinal score line (L2) so as to at least partly superpose on the fifth reinforcing flap (R5): in this way the fourth portion (P4) of the central sector (SC), with the fifth reinforcing flap (R5) and sixth reinforcing flap (R6) folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F).

The first lateral enveloping flap (A1) is foldable about the first longitudinal score line (L1) for maintaining a raised position with respect to the first portion (P1) on which the base of the article to be packed will be placed, in such a way as to be usable for covering and enveloping a third lateral flank of the article to be packed, while the second lateral enveloping flap (A2) is foldable about the second longitudinal score line (L2) for maintaining a raised position with respect to the first portion (P1), in such a way as to be usable for covering and enveloping the fourth flank, opposite the third, of the article to be packed (see for example FIGS. 1A, 1B).

Figures from 1A to 1E show the shape of the box that can be formed starting from the cardboard blank once the reinforcing flaps have been folded above the relative portions present on the central sector of the cardboard blank; the box will be conformed-to-measure on the basis of the effective dimensions of the base, the lateral flanks, the upper wall of the article to be packed.

In particular, the first lateral enveloping flap (A1) comprises a pair of longitudinal folding lines (a, b) parallel and realised at a distance such that on the first flap (A1), between the two folding lines (a, b), a third lateral closing wall (C3) is identified, having a height corresponding to the height of a third lateral flank of the article to be packed, and also a first folding tab (a1), between the third lateral closing wall (C3) and the first longitudinal score line (L1), and a second folding tab (a2), between the third lateral closing wall (C3) and the longitudinal edge (BL) of the cardboard blank (C) are identified.

The first folding tab (a1) is superposed on a part of the first portion (P1) once it has been rotated with respect to the first longitudinal score line (L1), so as to form a reinforcing edge, while the second folding tab (a2) is destined, once the third lateral closing wall (C3) has been folded with respect to the first folding tab (a1) for covering the third flank of the article, to be folded with respect to the third lateral closing wall (C3) for covering a portion of the upper face of the article, before the face is covered by the upper closing wall (PS).

Correspondingly, the second lateral enveloping flap (A2) comprises a pair of longitudinal folding lines (c, d) parallel and realised at a distance such that on the second flap (A2) a fourth lateral closing wall (C4) is identified, having a height corresponding to the height of a fourth lateral flank of the article to be packed, opposite the third flank, and also a third folding tab (a3), between the fourth lateral closing wall (C4) and the second longitudinal score line (L2), and a fourth folding tab (a4), between the fourth lateral closing wall (C4) and the second longitudinal edge (BL) of the cardboard blank (C) are identified.

The third folding tab (a3) is superposed on a part of the first portion (P1) once it has been rotated with respect to the second longitudinal score line (L2), so as to form a reinforcing edge, while the fourth folding tab (a4) is destined, once the fourth lateral closing wall (C4) has been folded with respect to the third folding tab (a3) for covering the fourth flank of the article, to be folded with respect to the fourth lateral closing wall (C4) for covering a portion of the upper face of the article, before the face is covered by the upper closing wall (PS) (see FIGS. 1C-1F).

SUMMARY OF THE INVENTION

The present invention has the aim of providing a closing station for closing a cardboard box which has been formed about an article, starting from a cardboard blank of FIG. 1A, i.e. a cardboard blank predisposed with the reinforced walls, and which is partly folded about an article which is arranged resting on the first portion of the central sector of the cardboard blank so that the second lateral closing wall, the third lateral closing wall, the fourth lateral closing wall of the cardboard blank are folded so as to envelop and cover three lateral flanks and the upper closing wall folded so as to cover the upper face of the article, leaving the lateral flank of the article facing towards the first lateral closing wall uncovered.

In particular, the present invention has the aim of making available a closing station able to rapidly and effectively carry out a rotation and folding of the first lateral closing wall of the cardboard blank facing towards the uncovered lateral flank of the article and the rotation, folding and gluing of the closing tab, hinged to the upper closing wall, against the first lateral closing wall once the first lateral closing wall has been folded to cover the flank of the article.

More precisely, the present invention has the aim of providing a closing station which receives in inlet a cardboard box (SCA) partially open and containing an article (D) internally thereof and which comprises: a base wall (CB), a first lateral closing wall (C1), hinged to a first transversal side of the base wall (CB), a second lateral closing wall (C2), hinged to a second transversal side of the base wall (CB), a third lateral closing wall (C3), hinged to a first longitudinal side of the base wall (CB), a fourth lateral closing wall (C4), hinged to a second longitudinal side of the base wall (CB), an upper closing wall (PS), hinged transversally to the second lateral closing wall (C2), on an opposite side with respect to the base wall (CB), and a closing tab (AC) hinged transversally to the upper closing wall (PS), on an opposite side with respect to the second lateral closing wall (C2), and with the article (D) arranged with the base thereof resting on the base wall (CB) with a first lateral flank facing towards the first lateral closing wall (C1), a second lateral flank, opposite the first, facing towards the second lateral closing wall (C2), a third lateral flank, transversal to the first two, facing towards the third lateral closing wall (C3), and a fourth lateral flank, opposite the third flank, facing towards the fourth lateral closing wall (C4). the cardboard box (SCA) being such that the first lateral closing wall (C1) is arranged on the same plane as the base wall (CB) so that the first flank of the article is uncovered, the second lateral closing wall (C2) being folded with respect to the base wall (CB) so as to cover the second lateral flank of the article, the third lateral closing wall (C3) being folded with respect to the base wall (CB) so as to cover the third lateral flank of the article, the fourth lateral closing wall (C4) being folded with respect to the base wall (CB) so as to cover the fourth lateral flank of the article, and with the upper closing wall (PS), being folded with respect to the second lateral closing wall (C2) so as to cover the upper face of the article (D) and be arranged above the ends of the third and fourth lateral closing walls, and which is predisposed so as to block the box (SCA) and realise:

- the rotation of the first lateral closing wall (C1) with respect to the base wall (CB) so as to fold the first lateral closing wall (C1) with respect to the base wall (CB) and position it facing so as to cover the first lateral flank of the article (D) and at the same time the application of glue on an upper portion of the first lateral closing wall (C1),
- and the rotation of the closing tab (AC) with respect to the upper closing wall (PS) so as to fold it with respect to the upper closing wall (PS) so as to arrange it above and against the first lateral closing wall (C1), and above the portion of the first lateral closing wall (C1) on which the glue has been applied, for reciprocally fixing and completely closing the cardboard box (SCA) about the article (D).

The present invention also has the aim of providing a machine for obtaining the cardboard blank described in the foregoing and illustrated in FIG. 1, starting from a continuous strip of cardboard stored in a fanfold, and having dimensions corresponding to the effective dimensions of the base, the lateral flanks and the upper wall of the article to be packed, and for carrying out all the operations necessary for carrying out the packaging of an article internally of a box obtained from the cardboard blank.

The objective of the invention is also to provide a machine able to carry out all the operations necessary for completing the packaging of an article internally of a cardboard box, very rapidly and efficiently, with the aim of guaranteeing high productivity in terms of numbers of articles packaged per hour, up to even 1000 articles packaged per hour.

BRIEF DESCRIPTION OF THE DRAWINGS

The characteristics of a preferred embodiment of a closing station for folding a cardboard blank formed about an article, and a machine for packaging an article internally of a cardboard box obtained from a cardboard blank, of the present invention, will be described in the following with reference to the appended tables of drawings, in which.

Figure 1:
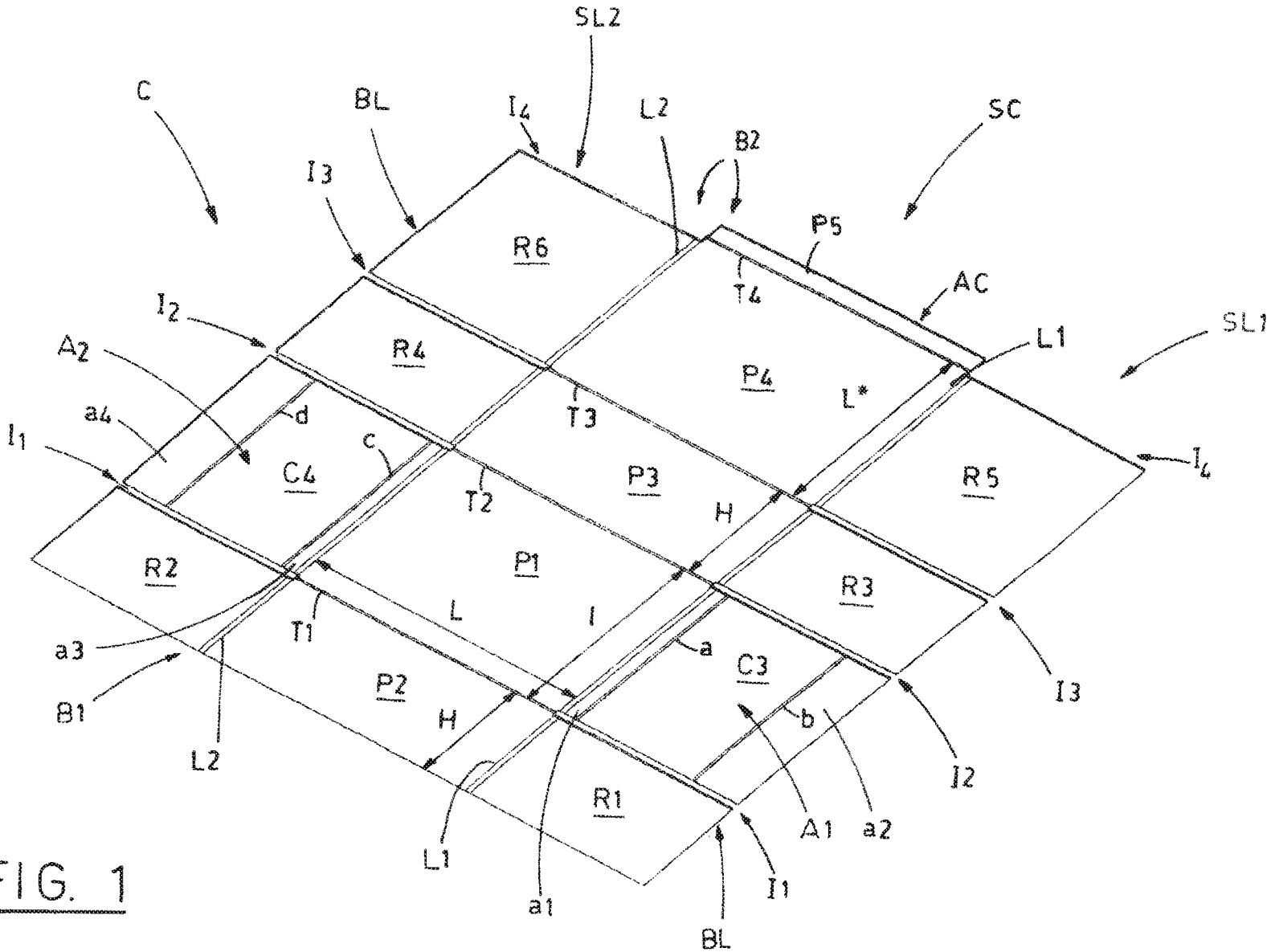
FIG. 1, mentioned in the preamble to the present description, in a perspective view illustrates the cardboard blank invented by the Applicant and object of the above-mentioned patent application, which is obtained and processed by the machine of the invention, so as to pack an article inside a cardboard box obtained from the cardboard blank.
Figure 2A:
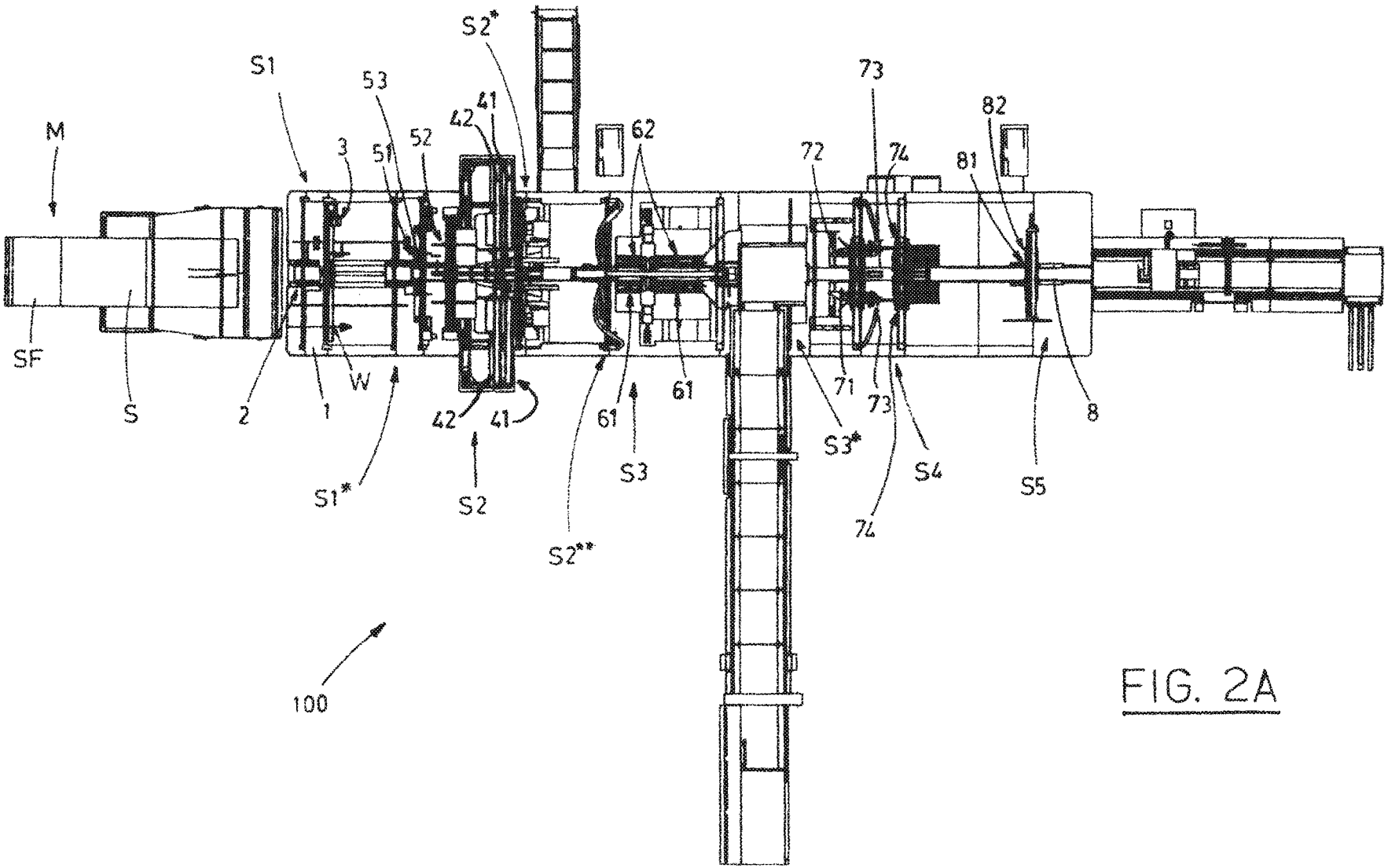
Figure 2B:
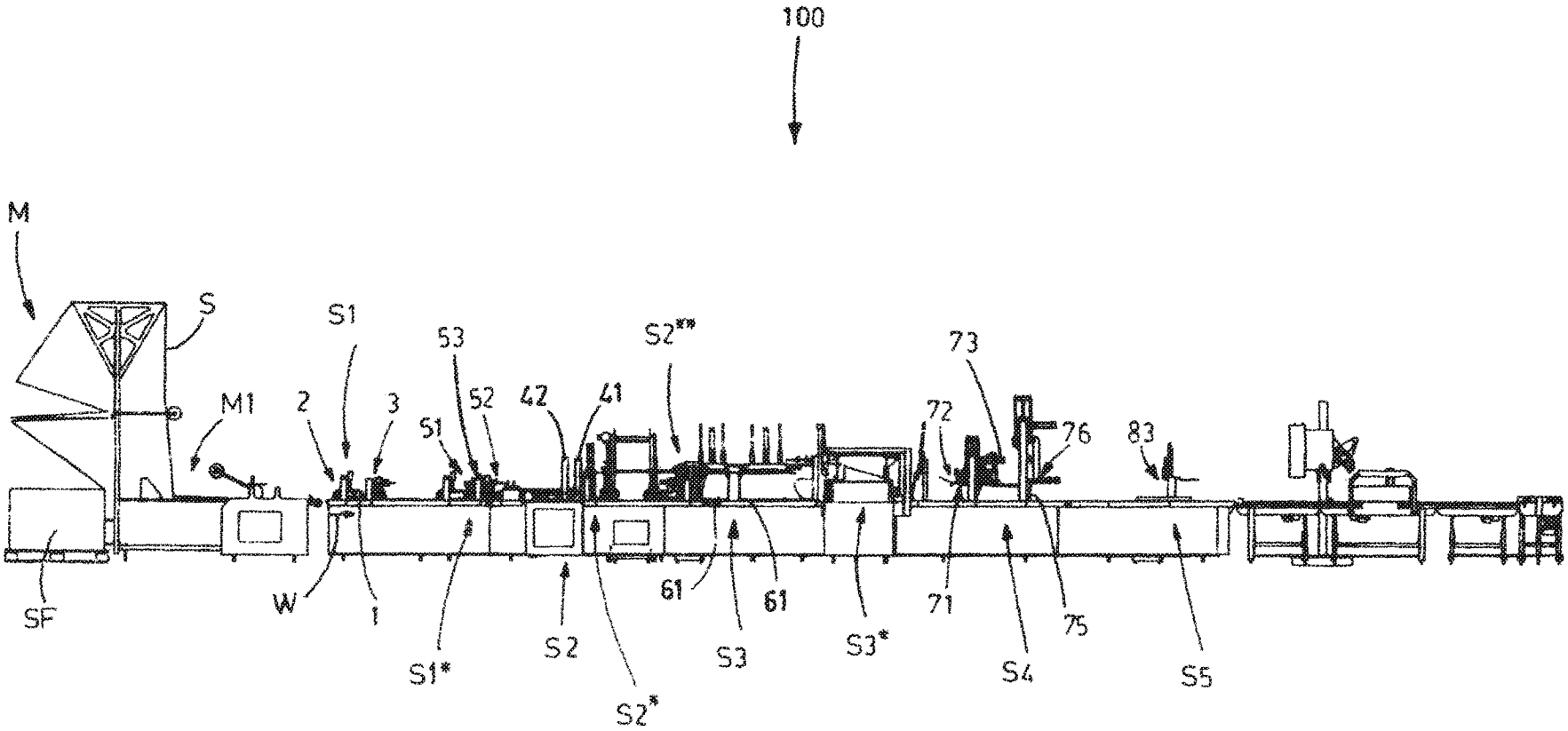
Figure 2C:
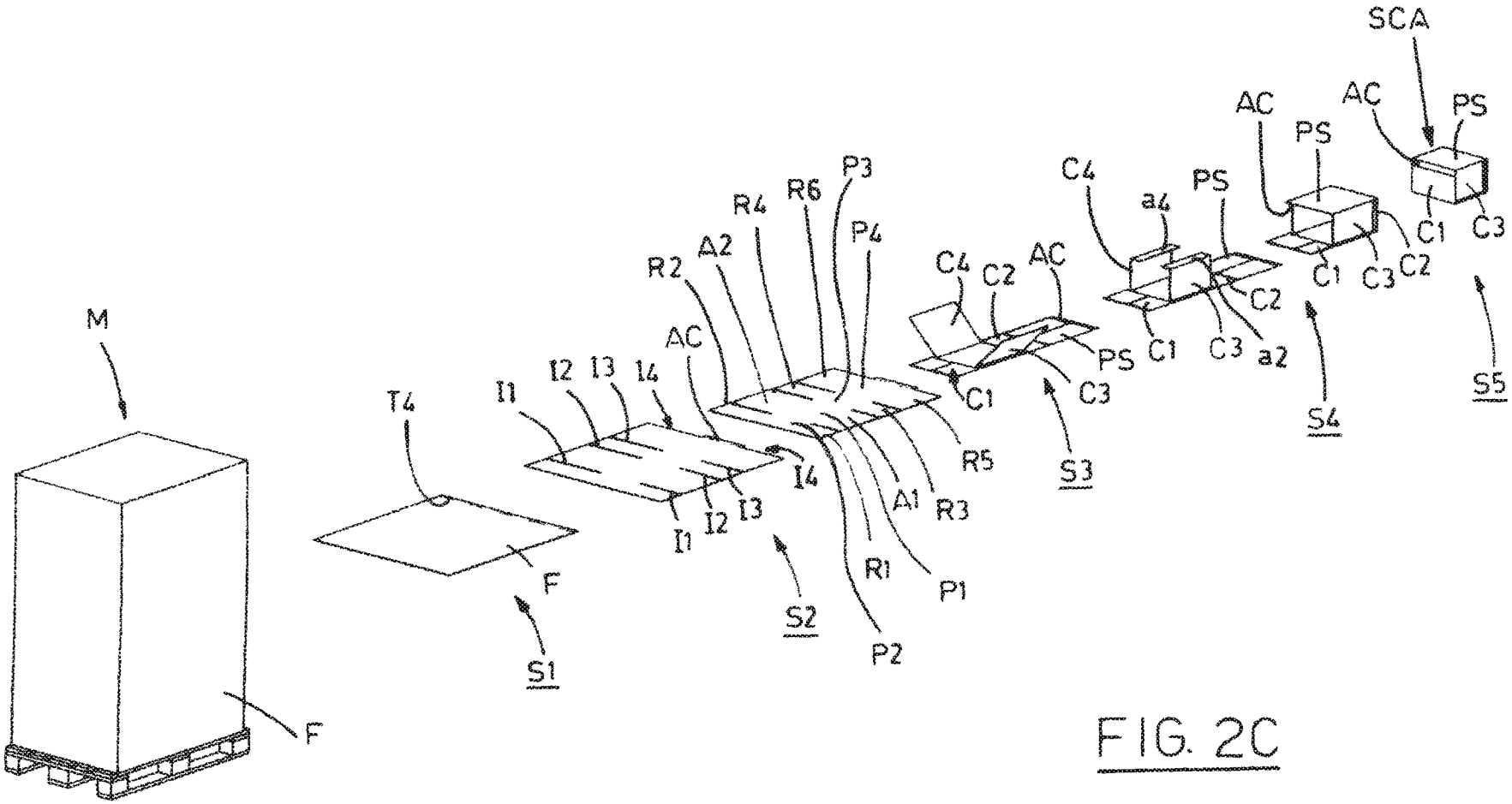
Figure 2D:
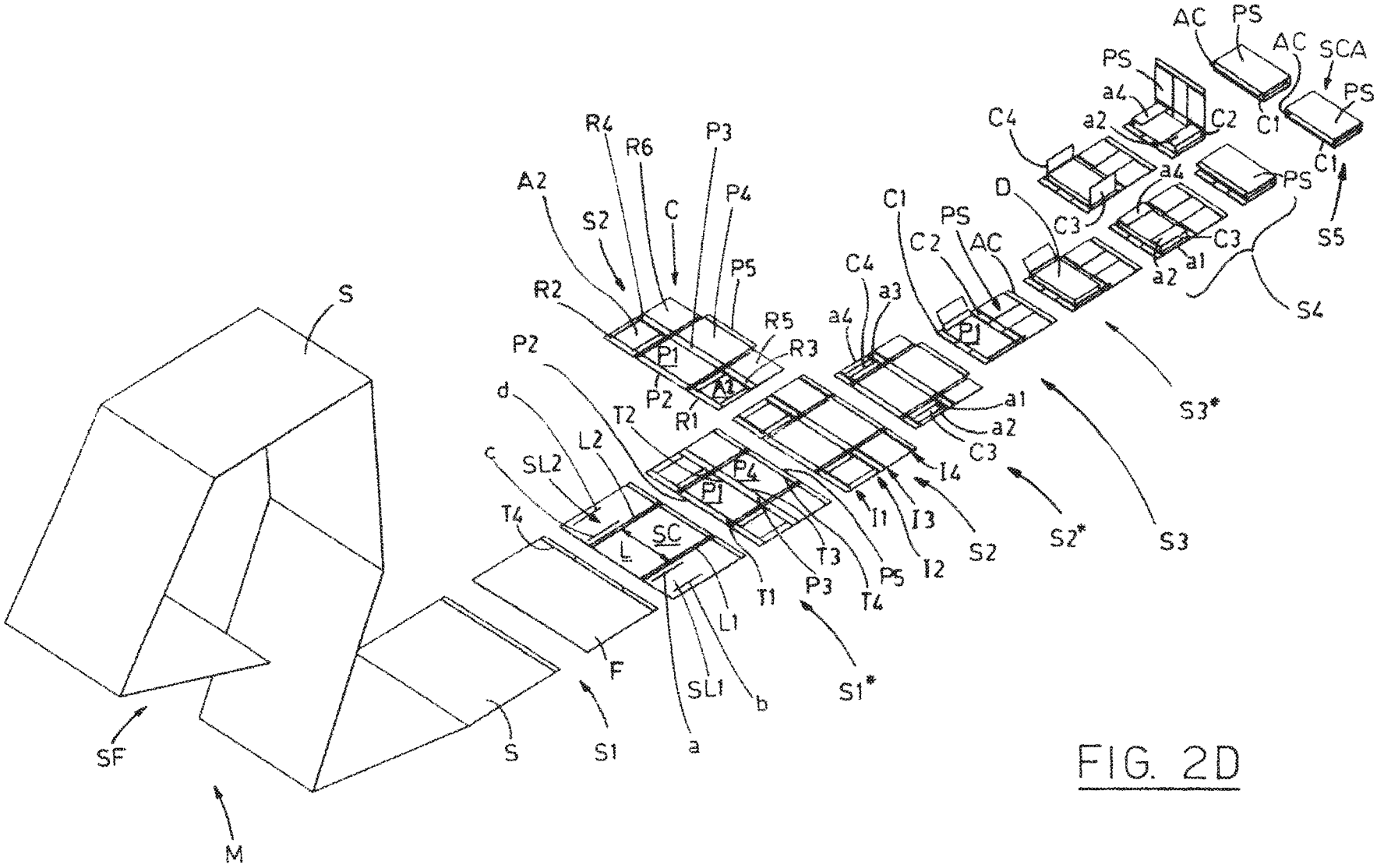
Figure 3A:
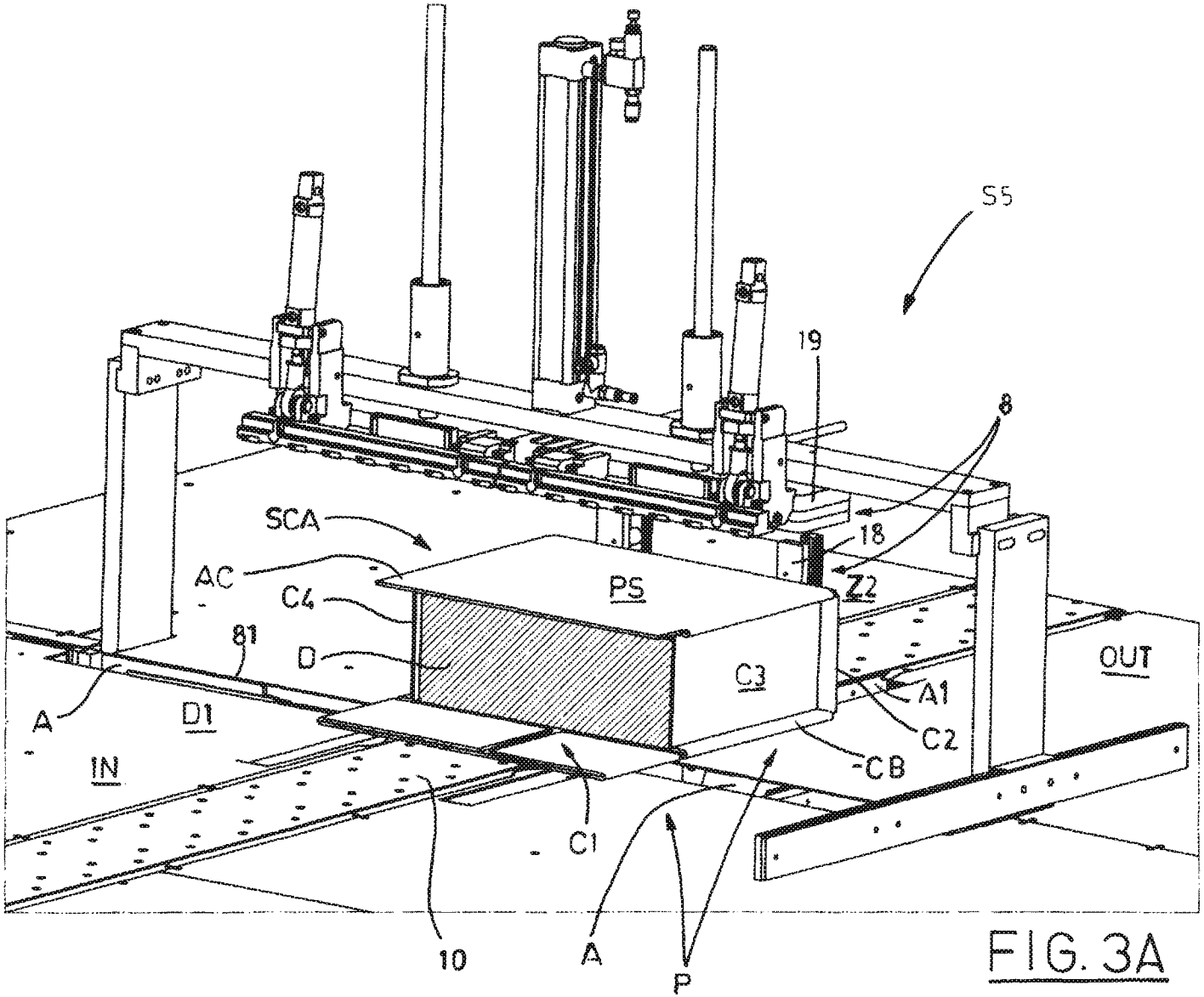
Figure 4A:
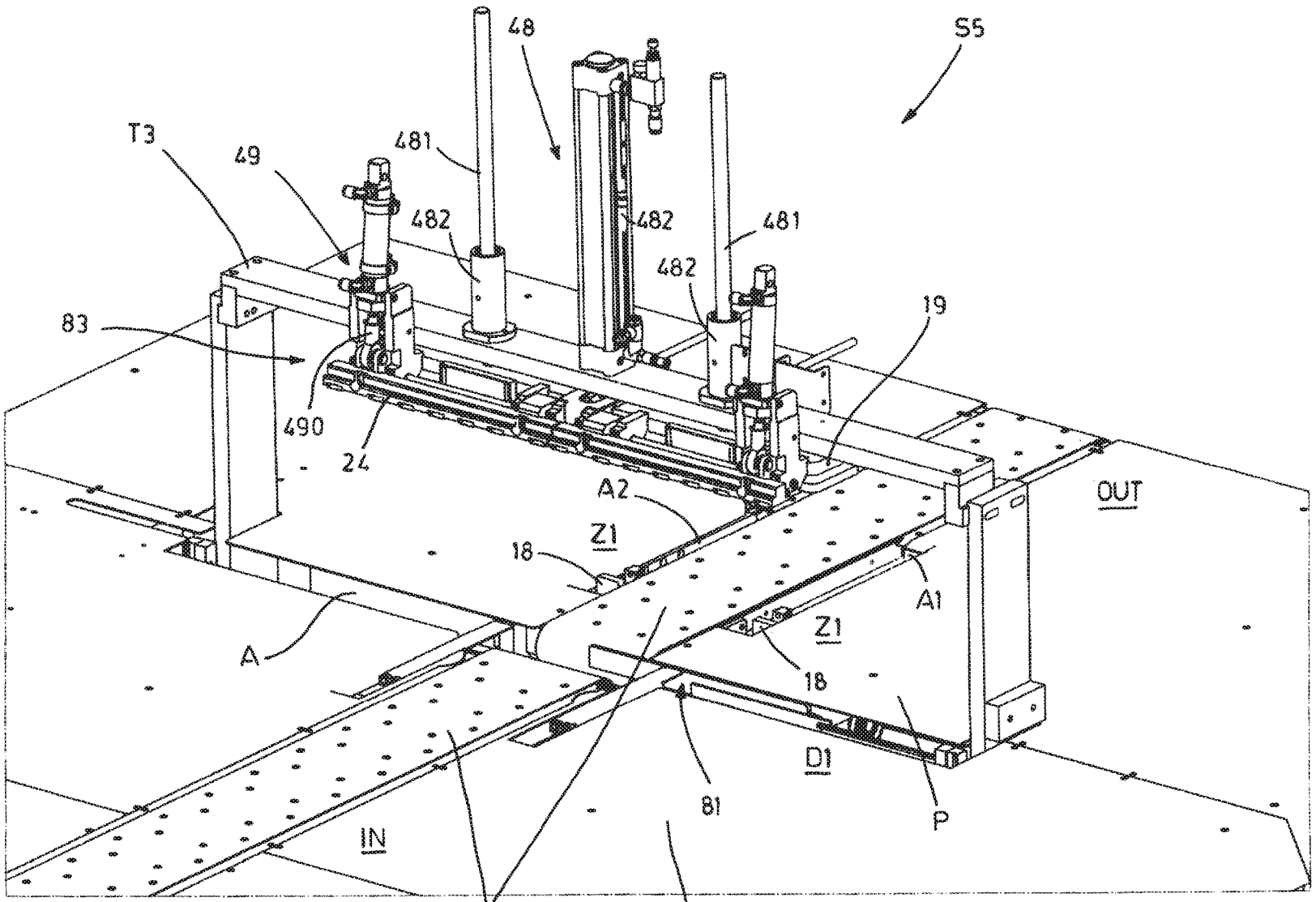
Figure 4B:
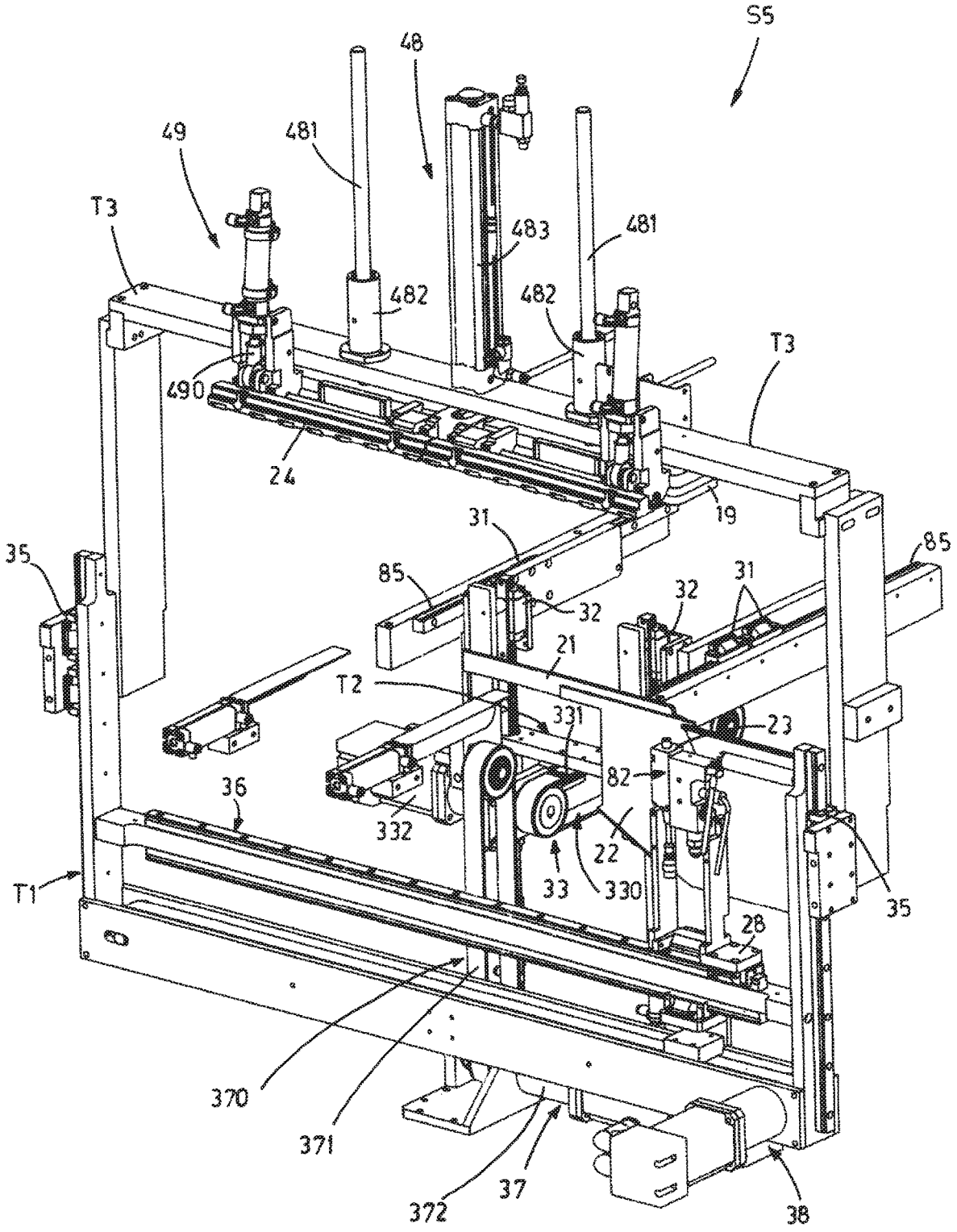
Figure 4C:
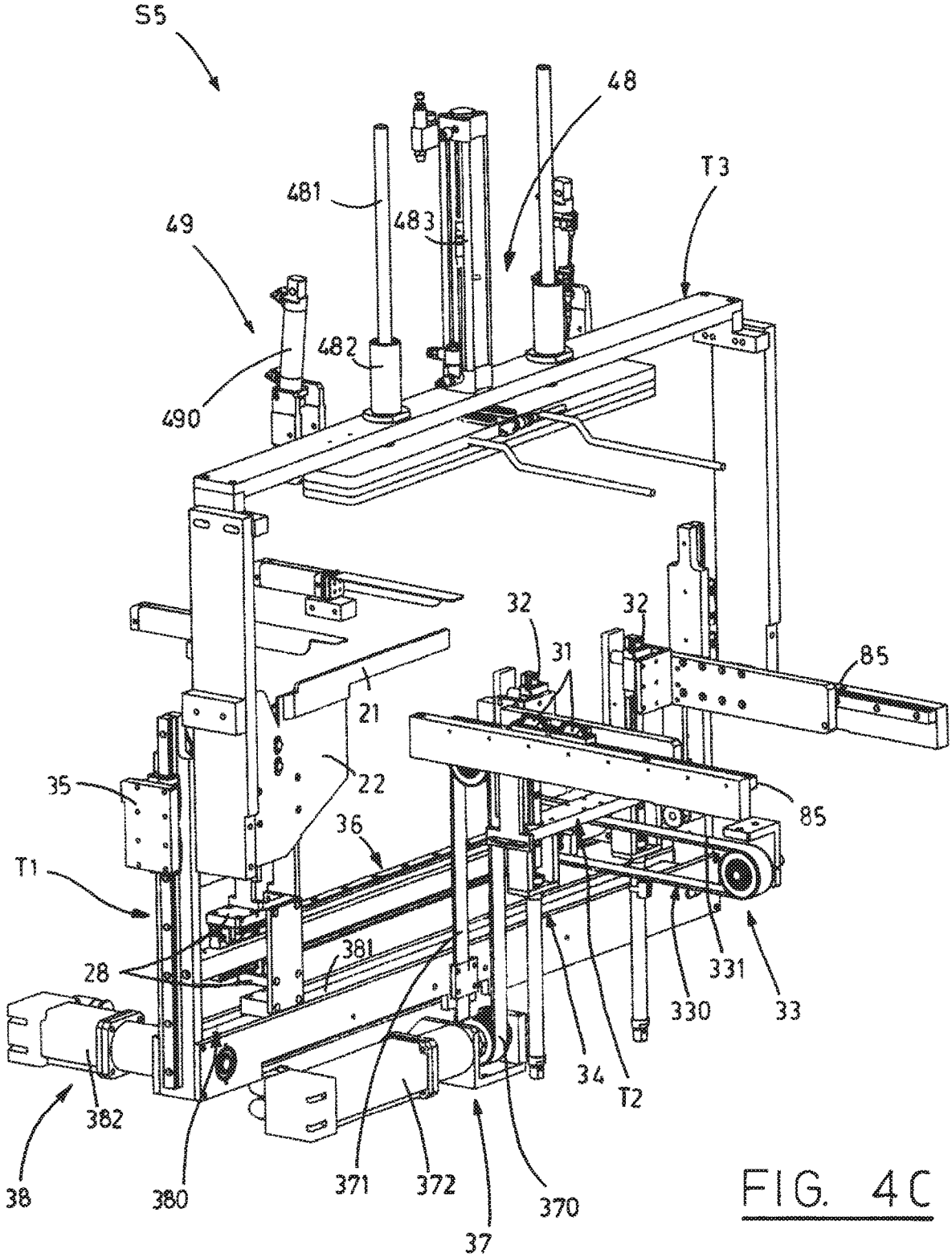
Figure 4D:
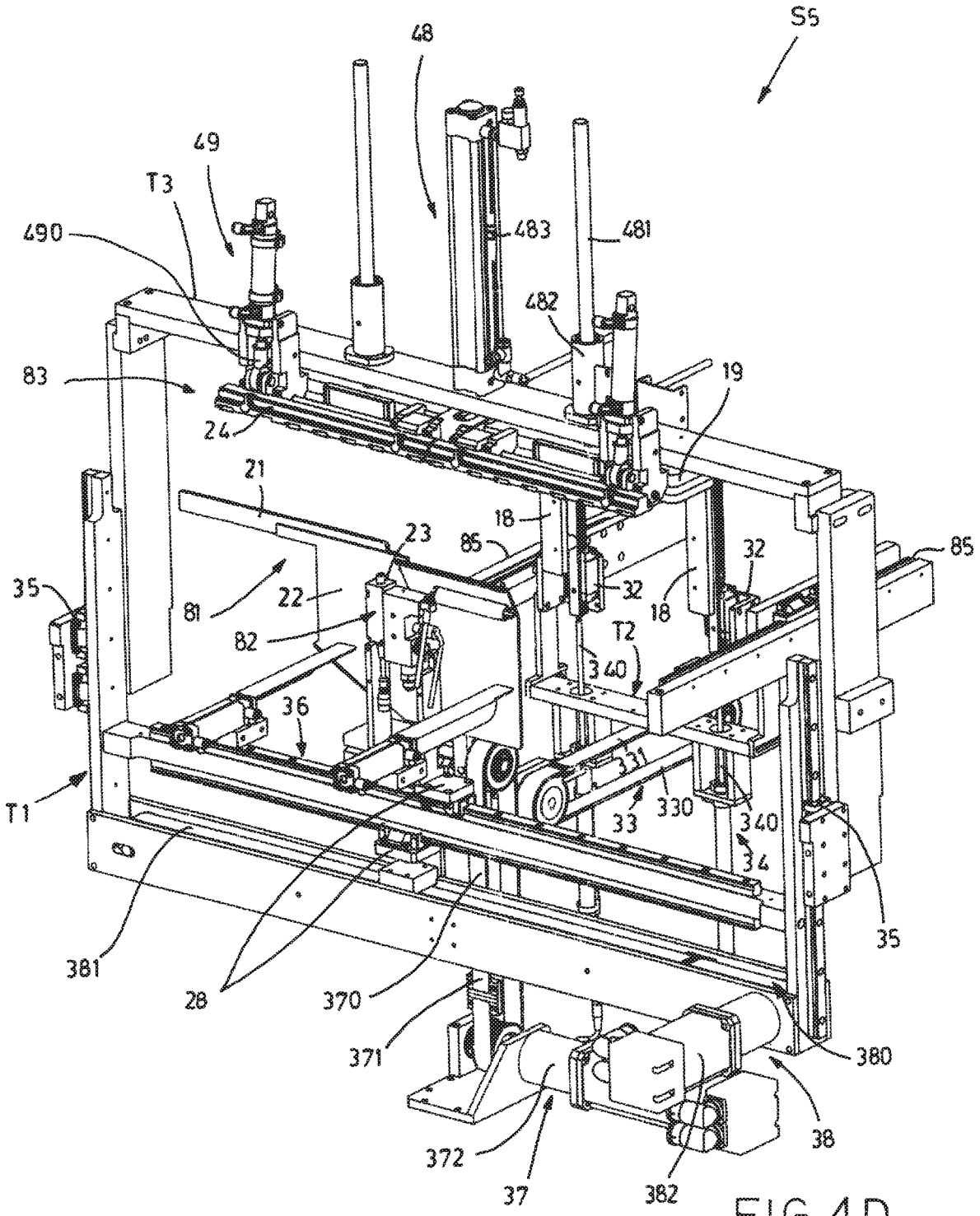

FIGS. from 1B to 1F illustrate, according to respective perspective views, possible folding steps of the cardboard blank of FIG. 1, described in the above-mentioned patent application filed by the Applicant, so as to enable obtaining a cardboard box for packing with an article closed inside it;

FIG. 2A illustrates, in a schematic view from above, the overall layout of a machine for packing an article internally of a cardboard box obtained from a cardboard sheet of the present invention;

FIG. 2B illustrates the machine of FIG. 2A in a lateral view;

FIG. 2C schematically illustrates, in a succession of images, example embodiments of some main work operations that the packaging machine of the invention carries out starting from a cardboard sheet cut from a continuous strip of cardboard contained in a fanfold, for obtaining first the cardboard blank illustrated in FIG. 1, and then folding the cardboard blank about an article and obtaining a completely closed cardboard box with the article packaged and closed inside it;

FIG. 2D very schematically illustrates, with a succession of images in perspective view, the operating sequence of the machine of the present invention;

FIGS. from 3A to 3G illustrate, each in a schematic perspective view, the closing station of the present invention in successive operating steps of closing the cardboard box formed about an article to be packed and partly open at a first lateral flank of the article;

FIG. 4A illustrates, in a schematic perspective view, the closing station of the present invention in a non-operative configuration, awaiting a cardboard box formed about an article and partly open at a first lateral flank of the article (such as the one illustrated in FIG. 3A);

FIG. 4B illustrates, again in a schematic perspective view, some significant components of the closing station of the present invention in a possible further configuration thereof, with some parts of the closing station having been removed for greater clarity;

FIG. 4C illustrates, in a schematic perspective view from a different angle, the components of FIG. 4B, FIG. 4D illustrates, in a schematic perspective view, the components of the closing station of FIG. 4A in a further possible operating configuration thereof.

DESCRIPTION OF THE PREFERRED EMBODIMENTS

With reference to the appended FIGS. of the drawings, (S5) denotes the closing station for closing a cardboard box (SCA) formed about an article to be packed (D) and partly open at a first lateral flank of the article (D), object of the present invention, while reference numeral (100) denotes the machine for packaging an article internally of a cardboard box obtained from a cardboard blank in its entirety, and comprising, among the various work stations, the closing station (S5).

The closing station (S5) of the invention comprises an inlet (IN), an outlet (OUT), a sliding plane (P) between the inlet (IN) and the outlet (OUT), and a conveyor (10) which extends from the inlet (IN) to the outlet (OUT) along the sliding plane (P).

The closing station (S5) is designed to receive, at the inlet (IN) thereof, a cardboard box (SCA) formed about an article (D) and still partly open.

Figure 1A:
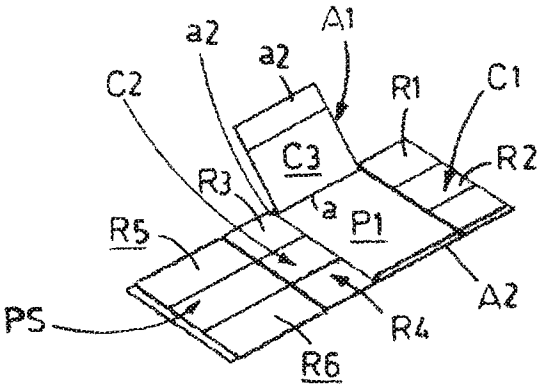
FIG. 1A, also mentioned in the foregoing, illustrates, in a perspective view, the cardboard blank with reinforced walls obtained by the cardboard blank of FIG. 1 following the folding of the reinforcing flaps above the respective portions present in the central sector (SC) of the cardboard blank, the cardboard blank being destined to restingly receive thereon a relative article and to be partly folded about the article so as to obtain a cardboard box (SCA) partly open and containing the article internally thereof which is received in inlet and processed by the closing station of the present invention, for obtaining a box (SCA) that is completely closed.

The cardboard box (SCA) which is received at the inlet (the) by the closing station (S5) is obtained from a cardboard blank as in FIGS. 1 and 1A. Therefore the cardboard box (SCA) is such as to comprise: a base wall (CB), a first lateral closing wall (C1), hinged to a first transversal side of the base wall (CB), a second lateral closing wall (C2), hinged to a second transversal side of the base wall (CB), a third lateral closing wall (C3), hinged to a first longitudinal side of the base wall (CB), a fourth lateral closing wall (C4), hinged to a second longitudinal side of the base wall (CB), an upper closing wall (PS), hinged transversally to the second lateral closing wall (C2), on an opposite side with respect to the base wall (CB), and a closing tab (AC) hinged transversally to the upper closing wall (PS), on an opposite side with respect to the second lateral closing wall (C2).

The article (D) is arranged resting with the base thereof on the first base wall (CB) and with a first lateral flank facing upstream towards the first lateral closing wall (C1), a second lateral flank, opposite the first flank, facing towards the second lateral closing wall (C2), a third lateral flank, transversal to the first two, facing towards the third lateral closing wall (C3), and a fourth lateral flank, opposite the third lateral flank, facing towards the fourth lateral closing wall (C4).

Figure 3B:
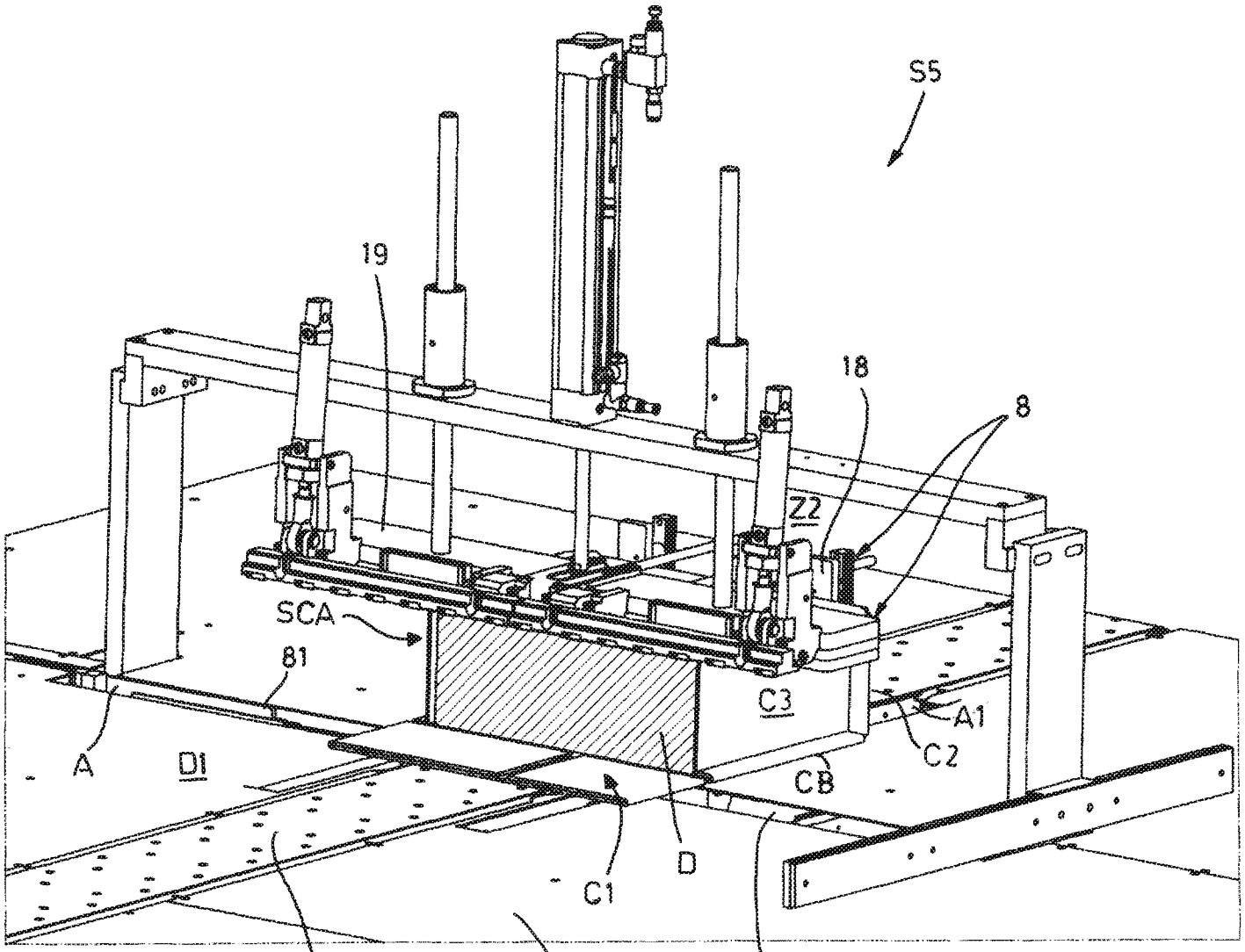
Figure 3C:
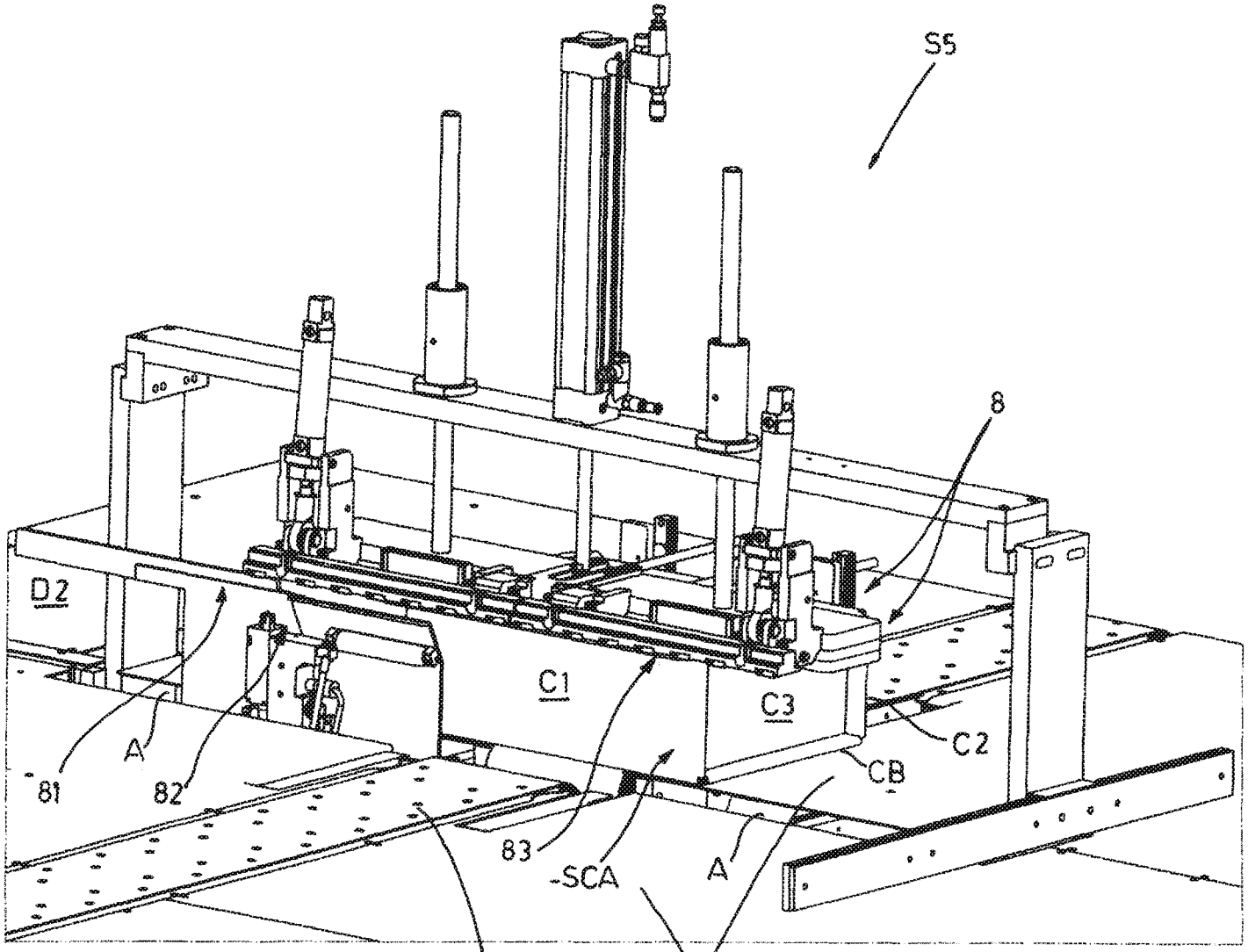

The cardboard box (SCA) has been formed about the article (D) in such a way that:

the first lateral closing wall (C1) is arranged on the same plane as the base wall (CB) so that the first flank of the article is uncovered;

the second lateral closing wall (C2) is folded with respect to the base wall (CB) so as to cover the second lateral flank of the article;

the third lateral closing wall (C3) is folded with respect to the base wall (CB) so as to cover the third lateral flank of the article;

the fourth lateral closing wall (C4) being folded with respect to the base wall (CB) so as to cover the fourth lateral flank of the article;

and with the upper closing wall (PS) being folded with respect to the second lateral closing wall (C2) so as to cover the upper face of the article (D and be arranged above the ends of the third (C3) and fourth (C4) lateral closing walls. The closing station (S5) of the invention is such that the sliding plane (P) comprises a transversal opening (A) arranged transversally to the conveyor (10); while the conveyor (10) is able to receive, at the inlet (IN), the cardboard box (SCA) enveloped about the article (D) with the base wall (CB) arranged resting on the conveyor (10) and with the first lateral closing wall (C1) facing upstream, and the first lateral flank of the article (D) facing upstream and transversal to the conveyor (10) (see for example FIG. 3A), and to convey the cardboard box (SCA) along the sliding plane (P) towards the outlet (OUT). The special aspect of the closing station (S5) of the present invention consists in the fact that it comprises:

stop means (8), predisposed and activatable with respect to the sliding plane (P) so as to abut the cardboard box (SCA) and to halt the cardboard box (SCA) when the base wall (CB) of the cardboard box (SCA) has passed beyond the transversal opening (A) so that the first lateral closing wall (C1) is situated above the transversal opening (A) (see FIGS. 3A and 3B);

first folding means (81) predisposed with respect to the sliding plane (P) so that they are movable between a lowered position (D1) (FIGS. 3A and 3B), in which they are positioned below the sliding plane (P), and a raised position (D2) (FIG. 3C), passing through the transversal opening (A), wherein they are situated at a higher level than the sliding plane (P), so as to be activatable, following a halting of the cardboard box (SCA) by the stop means (8), from the lowered position (D1) to the raised position (D2) for abutting the first lateral closing wall (C1) and rotating the first lateral closing wall (C1) with respect to the base wall (CB) so as to fold it with respect to the base wall (CB) and bring it into a vertical position facing and covering the first lateral flank of the article (D), and glue application means (82), predisposed so as to be associated to the first folding means (81) and to follow the movement thereof, and activatable for dispensing the glue.

Figure 3D:
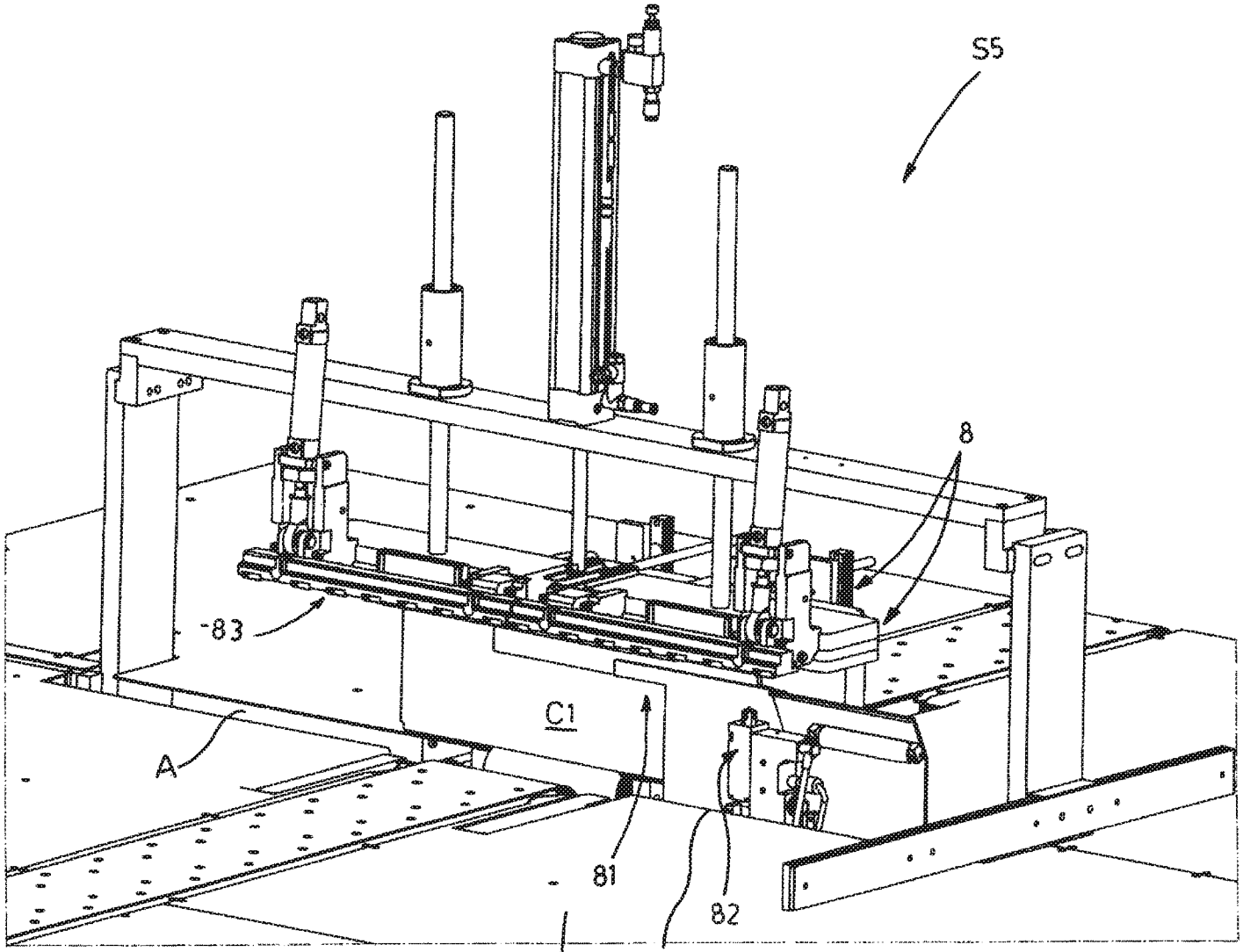
Figure 3E:
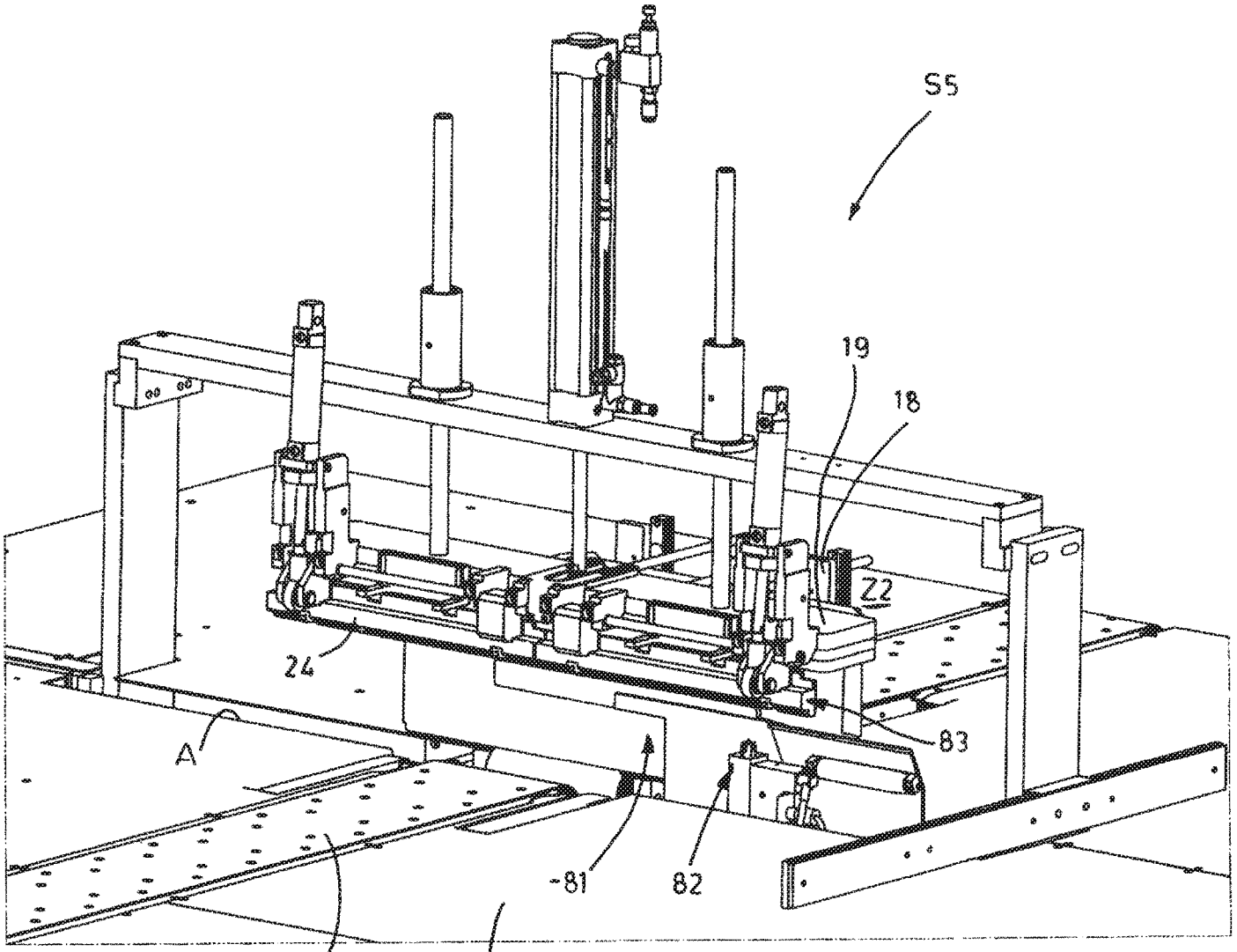
Figure 3F:
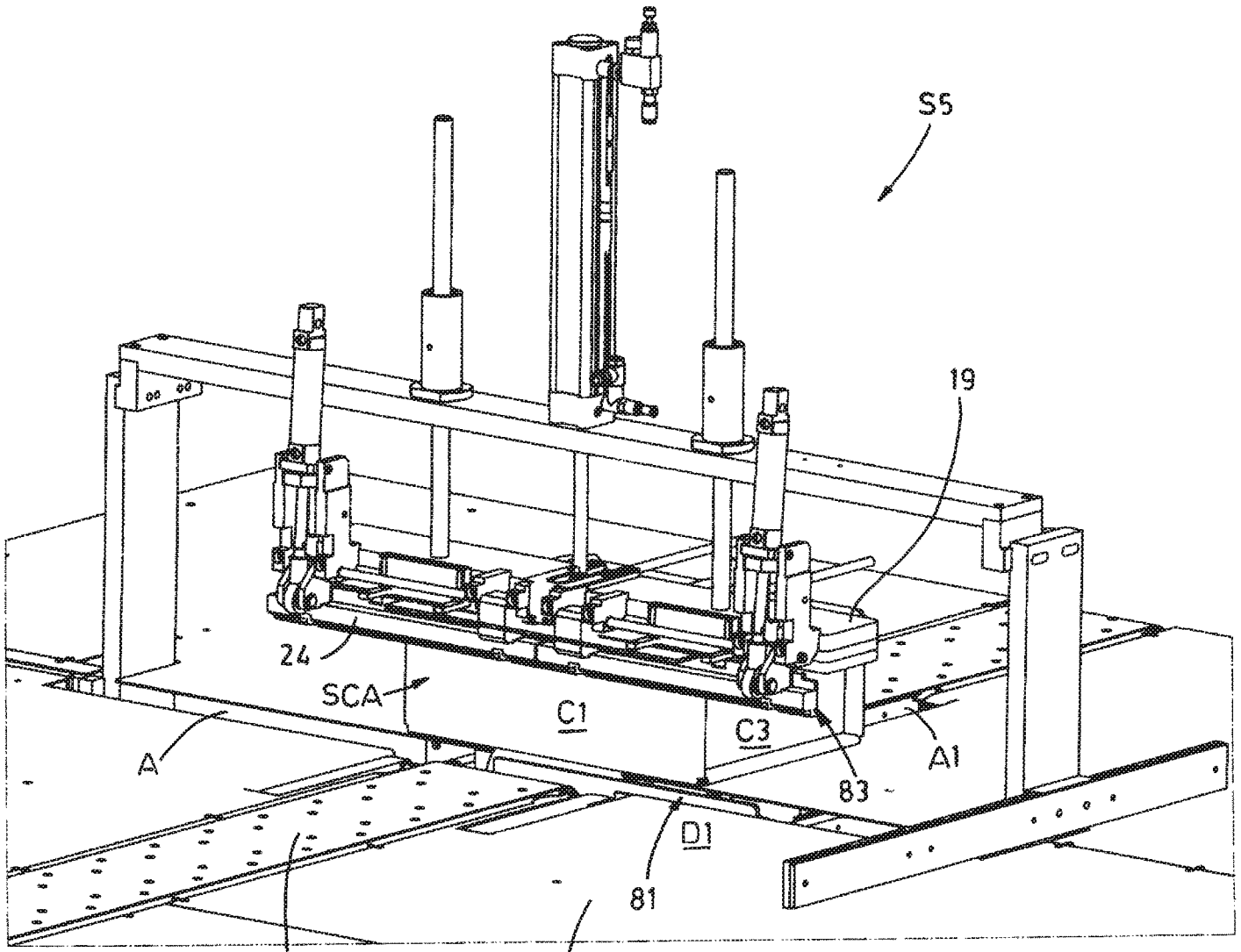
Figure 3G:
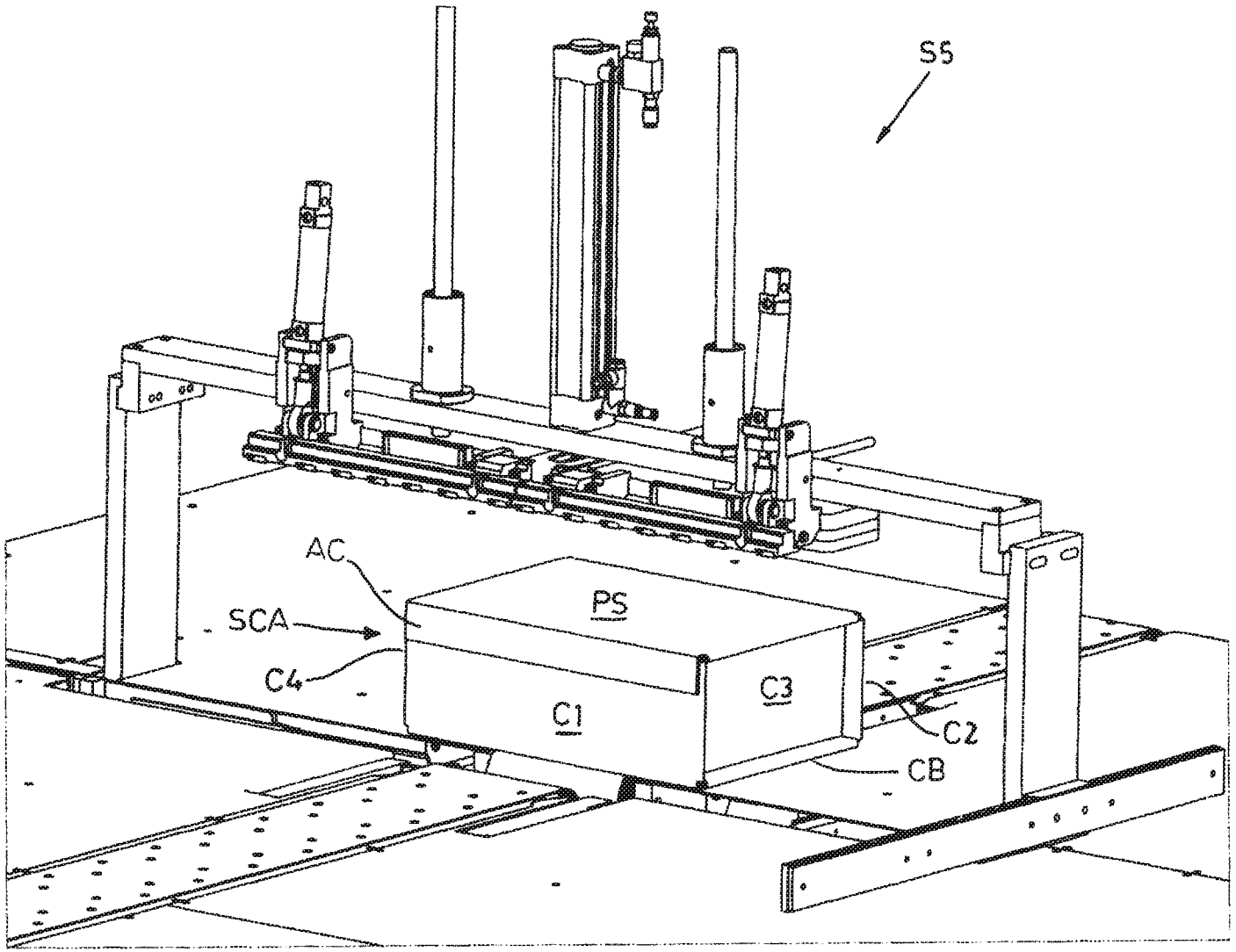

In particular, the first folding means (81) are further predisposed, once moved and positioned in the raised position (D2), above the sliding plane (P) (see FIG. 3C), so as to be transversally translatable with respect to the sliding plane (P) along the transversal opening (A) so that they can slide in contact with and along the first lateral closing wall (C1) for maintaining the first lateral closing wall (C1) folded against the first lateral flank of the article (D), the glue application means (82) being predisposed to be activated during the translation of the first folding means (81) along the transversal opening (A) for applying glue to the upper portions of the first lateral closing wall (C1) (see FIGS. 3D and 3E).

In this way, realising the folding of the first lateral closing wall (C1) against the first lateral flank of the article (D) takes place very rapidly, at the first lateral closing wall (C1) is maintained folded against the first lateral flank of the article (D) during the application of the glue.

A further special aspect of the closing station (S5) consists in the fact that it comprises second folding means (83), predisposed above the sliding plane (P) which are activatable for abutting the closing tab (AC) at the cardboard box (SCA) for rotating it with respect to the upper closing wall (PS) so as to fold it with respect to the upper closing wall (PS) and bring it against the first lateral closing wall (C1), above portions on which the glue application means (82) have applied glue, for reciprocally fixing and for completion of the closing of the cardboard box (SCA) (see for example FIGS. from 3D to 3F).

The closing tab (AC) will then enable a facilitated opening of the cardboard box by the consumer: it will be sufficient to detach it from the first lateral closing wall, by rotating the first lateral closing wall and extracting the article.

Further and other preferred aspects of the closing station (S5) of the invention are described in the following.

The sliding plane (P) further comprises two longitudinal openings (A1, A2) which are arranged between the transversal channel (A) and the outlet (OUT), at the sides of, and parallel to, the conveyor (10) (visible in particular for example in FIG. 4A).

The stop means (8) comprise a pair of abutting elements (18), each of which is positioned in a longitudinal opening (A1, A2) of the two longitudinal openings (A1, A2), and which, are predisposed in such a way as to be movable between a lowered position (Z1), in which they are situated beneath the sliding plane (P) (see for example FIG. 4A), and a raised position (Z2), passing through the two longitudinal openings (A1; A2), in which they are in a position at a higher level than the sliding plane (P), (see for example the FIGS. 3A, 3B), for providing a stop abutment for the cardboard box (SCA) advanced by the conveyor (10) along the sliding plane (P).

A particularly advantageous aspect of the closing station (S5) consists in the fact that the abutting elements (18) of the pair of abutting elements (18) are further predisposed so as to be translated alternatingly in opposite translation directions, longitudinally with respect to the longitudinal openings (A1, A2), in a parallel direction to the conveyor (10).

In this way it is possible to regulate and vary the position thereof along the longitudinal openings (A1, A2) of the sliding plane (P), and therefore adjust the distance thereof from the transversal channel (A), so as to be able to regulate the position thereof with respect to the actual dimensions of the cardboard box (SCA), in particular with respect to the dimensions of the base wall (CB), so as to position the first lateral closing wall (C1) is always positioned at the transversal opening (A) when it is halted by the abutting elements (18). The stop means (8) further comprise an abutting plate (19), predisposed above the sliding plane (P) and which is vertically mobile with respect to the sliding plane (P) so as to be lowered towards the sliding plane (P), once the abutting elements (18) of the pair of abutting elements (18) have been brought into the raised position (Z2) thereof for stopping the cardboard box (SCA), for abutting the upper closing wall (PS).

In this way the cardboard box (SCA) can be maintained stable and stationary during the activation of the first folding means (81) and the second folding means (83).

In the preferred embodiment illustrated in the accompanying FIGS. of the drawings, in particular FIGS. from 3C to 3E, and FIGS. from 4A to 4D, the first folding means (81) comprise a folding rod (21), a support plate (22) bearing the folding rod (21), and in that the glue application means (82) comprise at least a glue dispensing element (23) which is predisposed and borne by the support plate (22).

The second folding means (83) comprise a folding bar (24) that is situated above the sliding plane (P) transversally to the conveyor (10), and which is predisposed so as to be vertically mobile with respect to the sliding plane (P) and rotatable with respect to an axis that is parallel and transversal to the sliding plane (P) so as to able to abut the closing tab (AC) of the cardboard box (SCA), rotate it with respect to the upper closing wall (PS) so as to fold it with respect to the upper closing wall (PS) and take it against the first lateral closing wall (C1), above the portions on which the glue application means (82) have applied glue, for reciprocally fixing and for completion of the closing of the cardboard box (SCA).

In greater detail, the abutting plate (19) of the stop means (8) and the folding bar (24) of the second folding means (83) are predisposed so as to be vertically mobile with respect to the sliding plane (P), towards the sliding plane (P) or away from the sliding plane (P), at the same time, so that when the abutting plate (19) is lowered towards the sliding plane (P) for abutting the upper closing wall (PS) of the cardboard box (SCA), and for maintaining it stationary during the folding operations, the folding bar (24) will already be above the closing tab (AC) to be folded against the first lateral closing wall (C1) folded against the first lateral flank of the article (D).

Further and other preferred aspects of the closing station (S5) of the invention are as follows.

The closing station comprises a pair of longitudinal sliding guides (85) predisposed below the sliding plane (P) so as to be parallel to the pair of longitudinal openings (A1, A2) of the sliding plane (P) (see for example FIGS. from 4B to 4D), the abutting elements (18) of the pair of abutting elements (18) being predisposed so as to be translated along the longitudinal sliding guides (85) so as to be able to adjust a position thereof along the longitudinal openings (A1, A2) and a distance thereof from the transversal opening (A). The abutting elements (18) are further predisposed so as to be activatable in vertical translation with respect to the pair of longitudinal sliding guides (85) so as to be movable from the lowered position (Z1) thereof to the raised position (Z2) thereof, and vice versa.

The closing station (S5) further comprises a first frame (T1), predisposed below the sliding plane (P) and mounted slidably on relative vertical sliding guides (35); a transversal sliding guide (36) predisposed on the first frame (T1), the first frame (T1) being predisposed with respect to the sliding plane (P) so that the transversal sliding guide (36) is arranged transversally to the sliding plane (P), parallel to and aligned with the transversal opening (A) of the sliding plane (P).

The support plate (22) of the folding rod (21) of the first folding means (81) and of the glue application means (82) is predisposed to be borne by carriages (28) mounted slidably on the transversal sliding guide (36).

The closing station (S5) further comprises first movement means (37) predisposed to translatingly move the first frame (T1) (by raising and lowering it) alternatively along the vertical sliding guides (35) so as to move the first folding means (81) alternatingly between the relative lowered position (D1) and the relative raised position (D2); and second movement means (38) which are predisposed for translating the carriages (28) which bear the support plate (22) alternatingly along the transversal sliding guide (36) so as to translate the first folding means (81) and the glue application means (82) along the transversal opening (A) of the sliding plane (P) once brought into the relative raised position (Z2) (see FIGS. from 4B to 4D).

For example, the first movement means (37) comprise a belt (370) loop-wound on relative pulleys, of which one is a drive pulley, and which is arranged with the relative branches vertically disposed and with a first vertical branch (371) which is constrained to the first frame (T1), and a motor organ (372) for activating the drive pulley in rotation in opposite rotation directions.

The second movement means (38) in turn comprise a belt (380) loop-wound on relative pulleys, of which one is a drive pulley, and which is arranged with the relative branches horizontally disposed and transversal to the sliding plane (P) and to the conveyor (10), and parallel to the transversal channel (A), with a first horizontal branch (381) which is constrained to the carriages (28) slidably mounted on the transversal sliding guide (36), and which bear the support plate (22) of the first folding means (81) and of the glue application means (82), and a motor organ (382) for acting the drive pulley in rotation in opposite rotation directions.

The closing station (S5) further comprises a second frame (T2) mounted slidably by means of carriages (31) on the longitudinal sliding guides (85) of the pair of longitudinal sliding guides (85); vertical guide elements (32) predisposed on the second frame (T2), the abutting elements (18) of the pair of abutting elements (18) of the stop means (8) being mounted slidably on the vertical guide elements (32) of the second frame (T2).

Third movement means (33) which are predisposed for translatably alternatingly moving the second frame (T2) along the longitudinal sliding guides (85), and fourth movement means (34) predisposed to translatingly move the abutting elements (18) along the vertical guide elements (32) of the second frame (T2), so as to move the abutting elements (18) between the relative lowered position (Z1) and the relative raised position (Z2).

For example, the third movement means (33) comprise a belt (330) loop-wound on relative pulleys, of which one is a drive pulley, and which is arranged with the relative branches horizontally disposed and perpendicular to the transversal channel (A) and parallel to the two longitudinal channels (A1, A2), with a first horizontal branch (331) which is constrained to the second frame (T2), and a motor organ (332) for activating the drive pulley in rotation in opposite rotation directions.

The fourth movement means (34) comprise pistons (340), for example pneumatic or hydraulic, connected to the abutting elements (18).

The closing station (S5) lastly comprises also a third frame (T3), predisposed above the sliding plane (P), the abutting plate (19) of the stop means (8) being mounted on the third frame (T3) so as to be vertically mobile with respect to the third frame (T3), the folding bar (24) of the second folding means (83) being hinged to the abutting plate (19) according to a hinge axis that is transversal and parallel to the sliding plane (P).

In this regard, fifth movement means (48) for vertical movement of the abutting plate (19) with respect to the sliding plane (P), and sixth movement means (49) for activation in rotation of the folding bar (24) about the hinge axis with respect to the abutting plate (19).

For example, the fifth movement means (48) comprise vertical rods (481) slidably mounted in cylindrical guide elements (482) vertically mounted on the third frame (T3) and a piston (483), for example pneumatic or hydraulic, connected to the abutting plate (19), while the sixth movement means (49) comprise jacks (490), for example pneumatic or hydraulic, predisposed on a side of the abutting plate (19) and connected to the folding bar (24), so as, when activated, to rotate the folding bar (24) about the hinge axis by which it is hinged to the abutting plate (19).

As indicated in the preceding, in FIGS. 2A and 2B, in relative views from above and from the side, a layout of a machine (100) for packaging an article internally of a cardboard box is illustrated, obtained from a cardboard sheet of the present invention, and comprising the closing station (S5) described in the foregoing.

FIG. 2C and FIG. 2D schematically illustrate, in a succession of images, the various operations which the packaging machine (100) carries out starting from obtaining a cardboard sheet cut from a continuous strip of cardboard, for processing the cardboard sheet so as to obtain a cardboard blank for packaging, and the operations for wrapping the cardboard blank for packaging about an article and obtaining a closed cardboard box with the packaged article inside it.

In particular, FIG. 2C illustrates, with a series of images, some main operating steps of the machine of the invention, while FIG. 2D illustrates the complete succession of all the operating steps which the machine (100) performs for packaging an article internally of a cardboard box starting from a cardboard sheet cut from a continuous strip of cardboard, which operations include realising, starting from the cut cardboard sheet, a cardboard blank (C) such as the one illustrated in FIG. 1, and folding the cardboard blank about an article so as to package it and close it internally of a cardboard box.

The operating sequences illustrated in the succession of images in FIGS. 2C and 2D have been illustrated with reference to the packaging of two articles of different shapes and dimensions, and therefore both the cardboard blanks and the final boxes obtained in the two cases have a different shape and dimension.

This is also for demonstrating how the machine (100) of the present invention is able to package and close articles internally of the relative cardboard boxes independently of the dimensions of the articles, i.e. the machine (100) realises the cardboard for packaging on the basis of the effective dimensions of the articles so that the blanks can be folded about the articles and obtain the relative boxes with the packaged and packed articles internally of the boxes.

The machine (100) comprises:

- a store (M) in which a continuous strip of cardboard (S) is predisposed, folded in bellows fashion on itself to form a fanfold (SF);
- a sectioning station (S1) of a cardboard sheet (F) from the continuous strip of cardboard (S), which sectioning station (S1) is situated downstream of the store (M), and wherein the continuous strip of cardboard (S) unwound from the fanfold (SF) by means of an unwinding device (M1), is fed and advanced in an advancement direction (w) and cut so as to obtain a cardboard sheet (F) and wherein at the same time a transversal score line (T4) is realised, parallel to the cut edge on the continuous strip of cardboard (S);

a score line forming station (S1*), downstream of the sectioning station (S1), into which the cut cardboard sheet (F) is fed, coming from the sectioning station (S1), and on which cardboard sheet (F), the two longitudinal score lines (L1, L2) are realised, so as to identify, in the cardboard sheet, a central sector (SC) and two lateral sectors (SL1, SL2), and three transversal score lines (T1, T2, T3), for identifying, in the central sector (SC), together with the score line (T4) realised previously in the sectioning station (S1), the above described five portions (P1, P2, P3, P4, P5), and wherein in the portion of cardboard sheet of the two lateral sectors (SL1, SL2), two pairs of longitudinal folding lines (a, b) (c, d) are made at the flanks of the first portion (P1), which identify the first (a1), second (a2), third (a3) and fourth (a4) folding tabs of the two lateral folding flaps (A1, A2) from which the third (C3) and the fourth (C4) lateral closing walls of the cardboard blank are obtained.

In the score line forming station (S1*), the longitudinal score lines (L1, L2) and the transversal score lines (T1, T2, T3) are realised as a function of the effective dimensions of the article to be packed, in particular as a function of the dimensions of the base of the article (width L, length l) and of the height (H) of the flanks of the article.

In particular, for example, the two longitudinal score lines (L1, L2) are made at a mutual distance that is equal to the length (L) of the base of the article, the first transversal score line (T1) is made at a distance from a first transversal edge (B1) of the cardboard sheet (upstream edge with respect to the infeed direction into the score line forming station) corresponding to the height (H) of a first flank of the article, the second transversal score line (T2) is made at a distance from the first transversal score line (T1) on the basis of the width (I) of the base of the article, the third transversal score line (T3) is made at a distance from the second score line (T2) corresponding to the height (H) of a second flank of the article, opposite the first flank, and at a distance from the fourth transversal score line (T4), corresponding to the score line (T4) which had previously been realised in the sectioning station (S1), corresponding to the width (L*) of the upper face of the article.

The above-mentioned sectioning station (S1) of a cardboard sheet (F) from the continuous strip of cardboard (S) comprises: a conveyor plane (1), predisposed so as to be able to restingly receive the continuous strip of cardboard (S) which is unwound from the fanfold (SF), conveying means (2), for advancing the continuous strip of cardboard (S) along the conveyor plane (1) in an advancement direction (w) and for halting the continuous strip of cardboard (S) for enabling cutting thereof, and a sectioning group (3), predisposed above the conveyor plane (1), for sectioning and cutting a cardboard sheet (F) from the continuous strip of cardboard (S) and contemporaneously realising the score line (T4) in proximity of the cut edge (which will constitute the fourth score line (T4) in the cardboard sheet). The score line forming station (S1*) comprises (FIGS. 2A, 2B):

first score line forming means (51) predisposed to realise, on the cardboard sheet (F), two longitudinal score lines (L1, L2) parallel to the advancement direction and parallel to the longitudinal edges (BL) of the cardboard sheet (F), distanced from one another by a distance corresponding to a length (L) of the base of the article to be packed, so as to identify, in the cardboard sheet (F), a central sector (SC) and two lateral sectors (SL1, SL2) (see for example the third image starting from the left in FIG. 2D);

second score line forming means (52) which are predisposed for realising, in the central sector (SC), the three transversal score lines (T1, T2, T3) parallel to one another and distanced so as to identify, in the central sector (SC), together with the fourth score line (T4) (which is the score line (T4) realised in the sectioning station (S1)), the above-mentioned five portions (P1, P2, P3, P4, P5) in the following way (see FIG. 1 and the fourth image starting from the left in FIG. 2D).

A first portion (P1), between the first transversal score line (T1) and the second transversal score line (T2) having dimensions corresponding to the base of the article to be packed;

a second portion (P2), between a first transversal edge (B1) of the cardboard sheet (F) and the first transversal score line (T1), having dimensions corresponding to a first flank of the article;

a third portion (P3), adjacent to the first portion (P1), between the second transversal score line (T2) and the third transversal score line (T3) having dimensions corresponding to a second flank of the article, opposite the first flank;

a fourth portion (P4), between the third score line (T3) and a fourth score line (T4) (which as mentioned is the score line (T4) that has been realised in the sectioning station (S1)) having dimensions corresponding to the upper face of the article;

and a fifth portion (P5) constituted by a strip of material of the cardboard sheet (F) beyond the fourth transversal score line (T4) and up to the second transversal edge (B2) of the cardboard sheet (F), which will constitute the closing/opening tab (AC) of the cardboard box.

In particular, the second score line forming means (52) are predisposed for realising the three transversal score lines (T1, T2, T3) from a longitudinal edge (BL) to the other longitudinal edge (BL) of the cardboard sheet (F), so that the transversal score lines involve also the two lateral sectors (SL1, SL2) of the cardboard sheet (F).

The score line forming station (S1*) lastly further comprises third score line forming means (53) which are predisposed so as to realise, in the portions of the cardboard sheet (F) of the two lateral sectors (SL1, SL2), at flanks of the first portion (P1), pairs of longitudinal folding lines (a, b), (c, d) parallel to the two folding lines (L1, L2) and having a same width extension as the first portion (P1).

The machine further comprises a transversal cutting station (S2), downstream of the score line forming station (S1*), into which the cardboard sheet (F) is fed in an advancement direction with the longitudinal score lines (L1, L2) and the four transversal score lines (T1, T2, T3, T4) and the pairs of folding lines (a, b), (c, d), into which cutting station (S2), for each of the two lateral sectors (SL1, SL2) four transversal cuts (I1; I2, I3, I4) are made on the cardboard sheet at the four transversal score lines (T1; T2, T3, T4), each at a relative transversal score line.

The transversal cutting station (S2) will provide, at the outlet thereof, as mentioned above, a cardboard blank for packaging (C) such as the one illustrated in the foregoing and illustrated in FIG. 1, that is, with the five portions (P1, P2, P3, P4, P5) in the central sector (SC), the six reinforcing flaps (R1, R2, R3, R4, R5, R6) and the two lateral enveloping flaps (A1, A2) in the two lateral sectors (SL1, SL2) (see also FIGS. 2C and 2D).

The transversal cutting station (S2) comprises cutting means (41, 42), for example constituted by two pairs of rotary cutting dies (41, 42) arranged on both sides of the cardboard sheet (F) for carrying out four transversal cuts (I1, I2, I3, I4) for each of the two lateral sectors (SL1, SL2) of the cardboard sheet (F), at the four transversal score lines (T1, T2, T3, T4), so as to obtain: at the two ends of the second portion (P2), a first reinforcing flap (R1) and a second reinforcing flap (R2); at the two ends of the first portion (P1), a first lateral enveloping flap (A1), containing the first pair of longitudinal folding lines (a, b) which identify a first folding tab (a1) between the folding line (a) and the first longitudinal score line (L1), a second folding tab (a2) between the folding line (b) and the edge of the first enveloping flap (A1), and a central part (C3) between the two longitudinal folding lines (a, b), and a second lateral enveloping flap (A2), containing the second pair of longitudinal folding lines (c, d) which identify a third folding tab (a3), between the folding line (c) and the second longitudinal score line (L2), a fourth folding tab (a4) between the folding line (d) and the edge of the second enveloping flap (A2) and a central portion (C4) between the two longitudinal folding lines (c, d); at the two ends of the third portion (P3), a third reinforcing flap (R3) and a fourth reinforcing flap (R4); at the two ends of the fourth portion (P4), a fifth reinforcing flap (R5) and a sixth reinforcing flap (R6); and forming, between the fourth transversal score line (T4) and the second transversal edge (B2), a tab (AC) for closing the cardboard box, so as to provide, at the outlet of the transversal cutting station (S2), a cardboard blank (C) for packing an article.

Downstream of this cutting station (S2), the machine (100) further comprises a successive series of work stations for carrying out the operations on the cardboard blank (C) that are necessary for realising the packaging of the article internally of a box obtained from the cardboard blank.

In detail, downstream of the transversal cutting station (S2), the machine (100) comprises, in succession one after another: a first folding station (S3), a feeding station (S3*) of the article to be packed, a second folding station (S4), for the partial folding of the cardboard blank about the article, and a closing station (S5) for the final folding of the cardboard blank about the article so as to obtain a closed cardboard box with the article inside, completely packed and packaged, which is made like the closing station of the present invention and described in the foregoing (see FIGS. 2A, 2B).

The first folding station (S3) is arranged downstream of the transversal cutting station (S2), into which the cardboard blank (C) is fed in an advancement direction and at which the cardboard blank (C) is halted and, simultaneously, i.e. in a single operation:

the first (R1) and second reinforcing flap (R2) are folded, with respect to the first (L1) and the second (L2) longitudinal score line, on the second portion (P2) of the central sector (SC), for obtaining the first lateral closing wall (C1);

the third (R3) and fourth reinforcing flap (R4), with respect to the first (L1) and the second (L2) longitudinal score line, on the third portion (P3) of the central sector (SC), for obtaining a second lateral closing wall (C2);

the fifth (R5) and sixth reinforcing flap (R6), with respect to the first (L1) and the second (L2) longitudinal score line, on the fourth portion (P4) of the central sector (SC), for obtaining an upper closing wall (PS);

the first folding tab (a1) of the first lateral enveloping flap (A1) is folded, with respect to the first longitudinal score line (L1), for superposing on a part of the first portion (P1) of the central sector (SC) and forming a reinforcing edge, leaving the central part (C3) of the first enveloping flap (A1) in the raised position, defining a third lateral closing wall (C3), and the third folding tab (a3) of the second lateral enveloping flap (A2) is folded, with respect to the second longitudinal score line (L2), for superposing a part of the first portion (P1) of the central sector (SC) and forming a reinforcing edge, leaving the central part (C4) of the second lateral enveloping flap (A2) in the raised position, so as to define a fourth lateral closing wall (C4) (see FIG. 1A, the fifth image from the left in FIG. 2C and the seventh image from the left in FIG. 2D).

As mentioned, these folding operations are carried out, as described in the foregoing, with the cardboard blank and simultaneously with one another, i.e. in a single action, therefore very rapidly and swiftly, required truly short pause times for the cardboard blank.

In this regard, the machine (100), in this first folding station (S3), comprises a first folding bar (61), arranged at a first side of the cardboard blank and rotatable about a rotation axis that is parallel to the advancement direction of the cardboard blank (C) so as to abut the first reinforcing flap (R1), the first folding tab (a1) of the first enveloping flap (A1), the third reinforcing flap (R3) and the fifth reinforcing flap (R5) present in the first lateral sector (SL1) of the cardboard blank (C), and to rotate them about the first longitudinal score line (L1) so as to fold and arrange them respectively: the first reinforcing flap (R1) above the second portion (P2) of the central sector (SC); the first folding tab (a1) above a part of the first portion (P1) of the central sector (SC); the third reinforcing flap (R3) above the third portion (P3) of the central sector (SC) and the fifth reinforcing flap (R5) above the fourth portion (P4) of the central sector (SC).

The machine (100) further comprises, once more in the first folding station (S3), also a second folding bar (62) arranged by a flank of the second side of the cardboard blank and which is rotatable about a rotation axis parallel to the advancement direction of the cardboard blank (C) so as to abut the second reinforcing flap (R2), the third folding tab (a3) of the second enveloping flap (A2), the fourth reinforcing flap (R4) and the sixth reinforcing flap (R6) present in the second lateral sector (SL2) of the cardboard blank (C), in order to rotate them about the second longitudinal score line (L2) so as to fold and arrange them respectively: the second reinforcing flap (R2) above the second portion (P2) of the central sector (SC); the third folding tab (a3) above a part of the first portion (P1) of the central. sector (SC); the fourth reinforcing flap (R4) above the third portion (P3) of the central sector (SC) and the sixth reinforcing flap (R6) above the fourth portion (P4) of the central sector (SC).

Figure 1B:
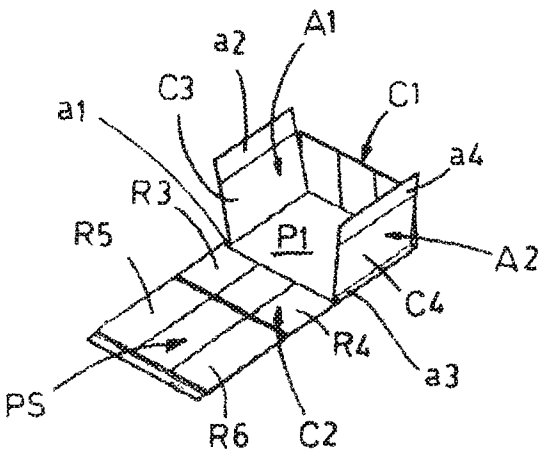
Figure 1C:
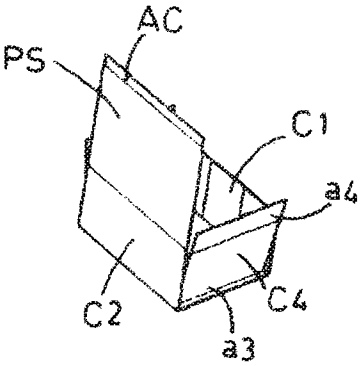
Figure 1D:
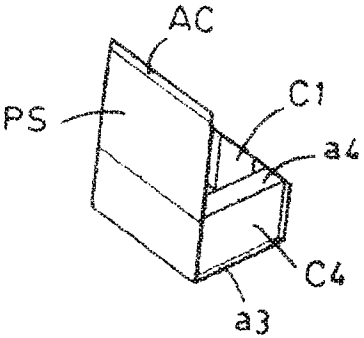
Figure 1E:
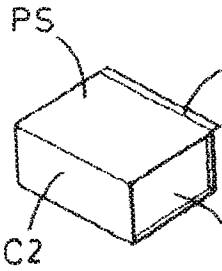
Figure 1F:
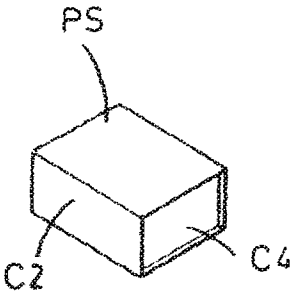

At the outlet of the first folding station (S3), the cardboard blank (C) has, formed upon it, the first lateral closing wall (C1), the second lateral closing wall (C2), the upper closing wall (PS), which all have a reinforced structure thanks to the reinforcing flaps folded and partially superposed on one another, and which are on the same plane as the first portion (P1) of the cardboard blank, while the third (C3) and fourth (C4) lateral closing wall are already partially erected and folded with respect to the central portion (P1) following the folding of the first folding tab (a1) and third folding tab (a3) above the first portion (P1), with the cardboard blank having the shape illustrated in the fifth image from the left in FIG. 2C, and also illustrated in FIG. 1B).

Downstream of this first folding station (S3), the machine (100) comprises a feeding station (S3*) of an article to be packed (see FIGS. 2A, 2B and 2D), at which an article (D) to be packed is deposited and rested, by the base wall thereof, on the first portion (P1) of the cardboard blank (C) (FIG. 2D), with a first flank facing towards the first lateral closing wall (C1), a second flank, opposite the first, facing towards the second lateral closing wall (C2), a third flank, transversal to the first two, facing towards the third lateral closing wall (C3), and a fourth flank, opposite the third, facing towards the fourth lateral closing wall (C4).

At this point, the machine (100) further comprises, downstream of the inserting station of the article (S3*), a second folding station (S4) to which the cardboard blank (C) with the article rested thereon, on the first portion (P1) thereof, is fed and advanced in an advancement direction.

In the second folding station (S4), the cardboard blank (C) is advanced in the advancement direction, and while the cardboard blank (C) is in motion, at the same time (see for example the third-last image of FIG. 2C, or the pair of the flanked two third-last images of FIG. 2D):

the third lateral closing wall (C3) is folded with respect to the folding line (a) which separates it from the first folding tab (a1) so as to cover the third flank of the article, and the second folding tab (a2) is folded with respect to the score line (b) which separates it from the third lateral closing wall (C3), so as to superpose it on a part of the upper face of the article, the fourth lateral closing wall (C4) is folded with respect to the score line (c) which separates it from the third folding tab (a3) so as to cover the fourth flank of the article, and the fourth folding tab (a4) is folded with respect to the score line (d) which separates it from the fourth lateral closing wall (C4), so as to superpose it on a part of the upper face of the article.

These folding operations, as mentioned, are carried out by advancing the cardboard blank along an advancement direction, and as soon as these folding operations have been completed, the machine (100) applies glue on the second (a2) and fourth (a4) folding tabs folded onto the upper face of the article.

The machine (100) also includes, again in the second folding station (S4), and once the glue has been applied, halting the cardboard blank and (see for example the penultimate image of FIG. 2 or the pair of the two penultimate images of FIG. 2D):

rotating the second lateral closing wall (C2), with respect to the second transversal score line (T2), so as to fold it with respect to the first portion (P1) on which the article (for example folded by 90°) is rested up to when it goes to cover the second flank of the article, and then, in sequence, rotating the upper closing wall (PS), with respect to the third transversal score line (T3), so as to fold it with respect to the second lateral closing wall (C2) (for example folded by 90°) up to when it goes to cover the upper face of the article.

For this purpose, the machine (100) comprises, in this second folding station (S4) (see FIGS. 2A, 2B):

first folding organs (71) for rotating the third lateral closing wall (C3) and folding the third lateral closing wall (C3) up to when it goes to cover the third flank of the article, and for rotating the second folding tab (a2), with respect to the score line (b) which separates it from the third lateral closing wall (C3), and folding the second folding tab (a2) up to superposing it on a part of the upper face of the article;

second folding organs (72) for rotating the fourth lateral closing wall (C4), and folding the fourth lateral closing wall (C4) up to when it goes to cover the fourth flank of the article, and for rotating the fourth folding tab (a4), with respect to the score line (d) which separates it from the fourth lateral closing wall (C4), so as to fold the fourth folding tab (a4) up to superposing it on a part of the upper face of the article;

glue dispensing means (73) predisposed for applying glue on the second (a2) and fourth (a4) folding tab folded onto the upper face of the article; blocking means (74), for blocking and halting the cardboard blank (C) once the means for dispensing glue (74) have applied the glue, third folding organs (75) for rotating the second lateral closing wall (C2), so as to fold it with respect to the first portion (P1) on which the article is rested up to when it goes to cover the second flank of the article, and fourth folding organs (76) for rotating, in succession, following the folding of the second lateral closing wall (C2), the upper closing wall (PS) so as to fold it with respect to the second lateral closing wall (C2) up to when it goes to cover the upper face of the article, and therefore provide in outlet from the second folding station (S4) a cardboard box (SCA) partially closed with the packed article internally thereof.

At this point, at the outlet of the second folding station (S4), the article is almost completely enveloped in the folded cardboard blank and the almost concluded packaging box.

The machine (100), therefore, transfers the cardboard box (SCA) formed about the article in the above-described way, to the final closing station (S5), situated downstream of the second folding station (S4), and which is realised as the closing station (S5) described in the foregoing and object of the invention, at which the cardboard box SCA) is stopped, the first lateral closing wall (C1) is rotated with respect to the first transversal score line (T1) and folded with respect to the first portion (P1) (for example by 90°) so that it goes to cover the first lateral flank of the article; at the same time as the folding of the first lateral closing wall (C1), glue is applied on the upper part of the first lateral closing wall (C1) (see the image on the left of the pair of last two images of FIG. 2D).

Lastly, following the completion of these operations, the machine (100), while still keeping the cardboard box stationary in the final closing station (S5), rotates the closing tab (AC) with respect to the fourth transversal score line (T4), and folds the closing tab (AC) with respect to the upper wall (PS) (for example by 90°) against the upper part of the first lateral closing wall (C1), to make it adhere thereto and complete the closure of the cardboard box with the packaged article internally thereof (see the last image of FIG. 2C and the image on the right of the pair of two further images of FIG. 2D).

The machine (100) then transfers the cardboard box, with the packaged article inside, to the outlet of the final closing station (S5), so that the cardboard box can be collected and directed towards a station for management and dispatch of orders.

The machine (100) further comprises, between the transversal cutting station (S2) and the first folding station (S3), also a trimming station (S2*), in which the cardboard blank can be trimmed along the longitudinal edges so as to adapt the width of the reinforcing flaps (R1, R2, R3, R4, R5, R6) to the effective dimensions of the second (P2), third (P3) and fourth portion (P4), so that the reinforcing flaps can effectively be folded above the portions, and at least partially superposed on one another, so as to adapt the width of the two lateral folding flaps (A1, A2), to the effective dimension of the third flank and fourth flank of the article.

The machine (100) also comprises, again between the transversal cutting station (S2) and the first folding station (S3), downstream of the trimming station (S2*), a glue applying station (S2**) comprising means for applying glue at least on reinforcing flaps (R1, R2, R3, R4, R5, R6) and/or on the second portion (P2), third portion (P3) and fourth portion (P4), on which the reinforcing flaps (R1, R2, R3, R4, R5, R6) have to be folded in the following first folding station (S3).

The invention claimed is:

1. A closing station for closing a cardboard box formed about an article and partly open, the cardboard box being such as to comprise:

a base wall, a first lateral closing wall hinged to a first transversal side of the base wall, a second lateral closing wall hinged to second transversal side of the base wall, a third lateral closing wall hinged to a first longitudinal side of the base wall, a fourth lateral closing wall hinged to a second longitudinal side of the base wall, an upper closing wall hinged transversally to the second lateral closing wall, on an opposite side with respect to the base wall, and a closing tab hinged transversally to the upper closing wall, on an opposite side with respect to the second lateral closing wall, and with the article arranged with the base thereof resting on the base wall and with a first lateral flank facing towards the first lateral closing wall, a second lateral flank, opposite the first, facing towards the second lateral closing wall, a third lateral flank, transversal to the first two, facing towards the third lateral closing wall, and a fourth lateral flank, opposite the third lateral flank, facing towards the fourth lateral closing wall, the cardboard box being such that the first lateral closing wall is arranged on the same plane as the base wall so that the first flank of the article is uncovered, the second lateral closing wall being folded with respect to the base wall so as to cover the second lateral flank of the article, the third lateral closing wall being folded with respect to the base wall so as to cover the third lateral flank of the article, the fourth lateral closing wall being folded with respect to the base wall so as to cover the fourth lateral flank of the article, and the upper closing wall being folded with respect to the second lateral closing wall so as to cover the upper face of the article and be arranged above the end of the third and fourth lateral closing walls, the closing station comprising an inlet, an outlet, a sliding plane between the inlet and the outlet, and a conveyor which extends from the inlet to the outlet along the sliding plane, wherein:

the sliding plane comprises a transversal opening arranged transversally to the conveyor;

the conveyor is able to receive, at the inlet, the cardboard box enveloped about the article with the base wall arranged resting on the conveyor and with the first lateral closing wall facing upstream, and the first lateral flank of the article facing upstream and transversal to the conveyor, and convey the cardboard box along the sliding plane towards the outlet;

the closing station comprising:

stop means, predisposed and activatable with respect to the sliding plane so as to abut the cardboard box and to halt the cardboard box when the base wall of the cardboard box has passed beyond the transversal opening so that the first lateral closing wall is situated above the transversal opening;

first folding means predisposed with respect to the sliding plane so that they are movable between a lowered position, in which they are positioned below the sliding plane, and a raised position, passing through the transversal opening, wherein they are situated at a higher level than the sliding plane, so as to be activatable, following a halting of the cardboard box by the stop means, from the lowered position to the raised position for abutting the first lateral closing wall and rotating the first lateral closing wall with respect to the base wall so as to fold the first lateral closing wall with respect to the base wall and bring the first lateral closing wall into a vertical position facing and covering the first lateral flank of the article, glue application means, predisposed so as to be associated to the first folding means and to follow the movement thereof, and activatable for dispensing the glue, the first folding means being further predisposed, once moved and positioned in the raised position above the sliding plane, so as to be transversally translatable with respect to the sliding plane along the transversal opening so that they can slide in contact with and along the first lateral closing wall for maintaining the first lateral closing wall folded against the first lateral flank of the article, the glue application means being predisposed to be activated during the translation of the first folding means along the transversal opening for applying glue to the upper portions of the first lateral closing wall;

second folding means, predisposed above the sliding plane and activatable for abutting the closing tab of the cardboard box for rotating the closing tab with respect to the upper closing wall so as to fold the closing tab with respect to the upper closing wall and take the closing tab against the first lateral closing wall, above portions on which the glue application means have applied glue, for reciprocally fixing and for completion of the closing of the cardboard box.

2. The closing station of claim 1, wherein the sliding plane further comprises two longitudinal openings arranged between the transversal opening and the outlet at the sides of and parallel to the conveyor, and in that the stop means comprise a pair of abutting elements each of which is positioned in a longitudinal opening of the two longitudinal openings, and which are predisposed so as to be movable between a lowered position, in which they are positioned below the sliding plane, and a raised position , passing through the two longitudinal openings, in which they are positioned at a higher level than the sliding plane, so as to provide a stop abutment for the cardboard box that has been advanced by the conveyor along the sliding plane, the abutting elements of the pair of abutting elements being further predisposed so as to be translated alternatingly in opposite translation directions, longitudinally with respect to the longitudinal openings, in a parallel direction to the conveyor, so as to be able to regulate the distance from the transversal opening, and therefore adjust the position thereof with respect to the actual dimensions of the cardboard box, or with respect to the dimensions of the base wall, so that the first lateral closing wall is always positioned at the transversal opening when the cardboard box is halted by the abutting elements.

3. The closing station of claim 2, wherein the stop means further comprise an abutting plate, predisposed above the sliding plane and vertically mobile with respect to the sliding plane so as to be movable towards the sliding plane, once the abutting elements of the pair of abutting elements have been brought into the raised position thereof for abutting and halting the cardboard box, for abutting the upper closing wall and maintaining the cardboard box stable and stationary during the activation of the first folding means and the second folding means.

4. The closing station of claim 1, wherein the first folding means comprise a folding rod, a support plate bearing the folding rod, and in that the glue application means comprise at least a glue dispensing element which is predisposed and borne by the support plate.

5. The closing station of claim 3, wherein the second folding means comprise a folding bar that is situated above the sliding plane transversally to the conveyor, and which is predisposed so as to be vertically mobile with respect to the sliding plane and rotatable with respect to an axis that is parallel and transversal to the sliding plane so as to able to abut the closing tab of the cardboard box, rotate the closing tab with respect to the upper closing wall so as to fold the closing tab with respect to the upper closing wall and take the closing tab against the first lateral closing wall, above portions on which the glue application means have applied glue, for reciprocally fixing and for completion of the closing of the cardboard box.

6. The closing station of claim 5, wherein the abutting plate of the stop means and the folding bar of the second folding means are predisposed so as to be vertically mobile with respect to the sliding plane, towards the sliding plane or away from the sliding plane, at the same time.

7. The closing station of claim 5, further comprising a pair of longitudinal sliding guides predisposed below the sliding plane such as to be parallel to the pair of longitudinal openings of the sliding plane, the abutting elements of the pair of abutting elements being predisposed so as to be translated along the longitudinal sliding guides so as to be able to adjust a position thereof along the longitudinal openings and a distance thereof from the transversal opening, and to be activatable in vertical translation with respect to the pair of longitudinal sliding guides so as to be movable from the lowered position thereof to the raised position thereof, and vice versa.

8. The closing station of claim 7, further comprising: a first frame, predisposed below the sliding plane and mounted slidably on relative vertical sliding guides; a transversal sliding guide predisposed on the first frame, the first frame being predisposed with respect to the sliding plane so that the transversal sliding guide is arranged transversally to the sliding plane, parallel to and aligned with the transversal opening of the sliding plane; the support plate of the folding rod of the first folding means and of the glue application means being borne by carriages mounted slidably on the transversal sliding guide; first movement means predisposed to translatingly move the first frame alternatively along the vertical sliding guides so as to move the first folding means alternatingly between the relative lowered position and the relative raised position; and second movement means predisposed for translating the carriages which bear the support plate alternatingly along the transversal sliding guide so as to translate the first folding means and the glue application means along the transversal opening of the sliding plane once brought into the relative raised position.

9. The closing station of claim 7, further comprising: a second frame mounted slidably by means of carriages on the longitudinal sliding guides of the pair of longitudinal sliding guides; vertical guide elements predisposed on the second frame, the abutting elements of the pair of abutting elements of the stop means being mounted slidably on the vertical guide elements of the second frame; third movement means which are predisposed for translatably alternatingly moving the second frame along the longitudinal sliding guides, and fourth movement means predisposed to translatingly move the abutting elements along the vertical guide elements of the second frame, so as to move the abutting elements between the relative lowered position and the relative raised position.

10. The closing station of claim 9, further comprising a third frame , predisposed above the sliding plane, the abutting plate of the stop means being mounted on the third frame so as be vertically movable with respect thereto, the folding bar of the second folding means being hinged to the abutting plate according to a hinge axis that is transversal and parallel to the sliding plane, and further comprising a fifth movement means for vertical movement of the abutting plate with respect to the sliding plane, and sixth movement means for activation in rotation of the folding bar about the hinge axis with respect to the abutting plate.

11. A machine for packing an article internally of a cardboard box obtained from a cardboard sheet, wherein the machine comprises:

a store in which a continuous strip of cardboard is predisposed, folded on itself to form a fanfold;

a sectioning station of a cardboard sheet from the continuous strip of cardboard, which sectioning station is situated downstream of the store and comprising: a conveyor plane, predisposed so as to be able to restingly receive the continuous strip of cardboard which is unwound from the fanfold, conveying means, for advancing the continuous strip of cardboard along the conveyor plane in an advancement direction and for halting the continuous strip of cardboard for enabling cutting thereof, a sectioning group, predisposed above the conveyor plane, for sectioning a cardboard sheet from the continuous strip of cardboard and contemporaneously realising a transversal score line parallel to the edge cut on the continuous strip of cardboard;

a score line forming station, downstream of the sectioning station, into which the cut cardboard sheet coming from the sectioning station is fed, and advanced in an advancement direction, comprising: first score line forming means predisposed to realise, on the cardboard sheet, two longitudinal score lines parallel to the advancement direction and parallel to the longitudinal edges of the cardboard sheet, distanced from one another by a distance corresponding to a length of the base of the article to be packed, so as to identify, in the cardboard sheet, a central sector and two lateral sectors;

second score line forming means that are predisposed for realising three transversal score lines parallel to one another, and parallel to the score line previously realised, and distanced so as to identify, in the central sector, together with a fourth score line, constituted by the score line previously realised in the sectioning station, five portions: a first portion, between the first transversal score line and the second transversal score line having dimensions corresponding to the base of the article to be packed; a second portion, between a first transversal edge of the cardboard sheet and the first transversal score line, having dimensions corresponding to a first flank of the article; a third portion, adjacent to the first portion, between the second transversal score line and the third transversal score line having dimensions corresponding to a second flank of the article, opposite the first flank; a fourth portion, between the third score line and the fourth transversal score line, having dimensions corresponding to the upper face of the article; and a fifth portion constituted by a strip of material of the cardboard sheet between the fourth transversal score line and the second transversal edge of the cardboard sheet;

and third score line means which are predisposed so as to realise, in the portions of the cardboard sheet of the two lateral sectors, at flanks of the first portion, pairs of longitudinal folding lines parallel to the two longitudinal score lines and having a same width extension as the first portion a transversal cutting station, downstream of the score line forming station, into which the cardboard sheet is fed in an advancement direction with the longitudinal score lines in the central sector, the four transversal score lines and the pairs of folding lines, in the two lateral sectors, comprising cutting means for carrying out four transversal cuts for each of the two lateral sectors of the cardboard sheet, at the four transversal score lines, so as to obtain: at the two ends of the second portion, a first reinforcing flap and a second reinforcing flap; at the two ends of the first portion, a first lateral enveloping flap, containing the first pair of longitudinal folding lines which identify a first folding tab, between the folding line and the first longitudinal score line, a second folding tab between the folding line and the edge of the first enveloping flap, and a central portion between the two longitudinal folding lines, and a second lateral enveloping flap, containing the second pair of longitudinal folding lines which identify a third folding tab, between the folding line and the second longitudinal score line, a fourth folding tab between the folding line and the edge of the second enveloping flap and a central portion between the two longitudinal folding lines, at the two ends of the third portion, a third reinforcing flap and a fourth reinforcing flap; at the two ends of the fourth portion, a fifth reinforcing flap and a sixth reinforcing flap; and forming, between the fourth transversal score line and the second transversal edge, a tab for closing the cardboard box, so as to provide, at the outlet of the transversal cutting station, a cardboard blank for packing an article;

a first folding station, downstream of the transversal cutting station, into which the cardboard blank is fed in an advancement direction and in which the cardboard blank is halted and comprising: a first folding bar, arranged at a first side of the cardboard blank and rotatable about a rotation axis that is parallel to the advancement direction of the cardboard blank so as to abut the first reinforcing flap, the first folding tab of the first lateral enveloping flap, the third reinforcing flap and the fifth reinforcing flap present in the first lateral sector of the cardboard blank, and to rotate them about the first longitudinal score line so as to fold and arrange them respectively: the first reinforcing flap above the second portion of the central sector; the first folding tab above a part of the first portion of the central sector; the third reinforcing flap above the third portion of the central sector and the fifth reinforcing flap above the fourth portion of the central sector; and a second folding bar arranged by a flank of the second side of the cardboard blank and which is rotatable about a rotation axis parallel to the advancement direction of the cardboard blank so as to abut the second reinforcing flap, the third folding tab of the second lateral enveloping flap, the fourth reinforcing flap and the sixth reinforcing flap present in the second lateral sector of the cardboard blank, in order to rotate them about the second longitudinal score line so as to fold and arrange them respectively: the second reinforcing flap above the second portion of the central sector; the third folding tab above a part of the first portion of the central sector; the fourth reinforcing flap above the third portion of the central sector and the sixth reinforcing flap above the fourth portion of the central sector, so that: the second portion with the first reinforcing flap and second reinforcing flap folded thereon form a first lateral closing wall; the third portion with the third and fourth reinforcing flaps folded thereon form a second lateral closing wall; the first folding tab of the first lateral enveloping flap folded above a part of the first portion of the central sector forms a reinforcing edge while the central part of the first lateral enveloping flap in a raised position defines a third lateral closing wall, and the third folding tab of the second lateral enveloping flap folded above a part of the first portion of the central sector forms a reinforcing edge, while the central part of the second lateral enveloping flap in a raised position defines a fourth lateral closing wall, a feeding station of an article to be packed, to which the cardboard blank coming from the first folding station is fed and wherein an article to be packed is deposited and rested by the base wall thereof on the first portion of the cardboard blank, with a first flank facing towards the first lateral closing wall, a second flank, opposite the first, facing towards the second lateral closing wall, a third flank, transversal to the first two, facing towards the third lateral closing wall, and a fourth flank, opposite the third, facing towards the fourth lateral closing wall;

a second folding station at which the cardboard blank with the article rested thereon, on the first portion thereof, is fed and advanced in an advancement direction and comprising: first folding organs for rotating the third lateral closing wall and folding the third lateral closing wall up to when it goes to cover the third flank of the article, and for rotating the second folding tab, with respect to the folding line which separates the third lateral closing wall from the third lateral closing wall, and folding the second folding tab up to superposing it on a part of the upper face of the article; second folding organs for rotating the fourth lateral closing wall, and folding the fourth lateral closing wall up to when it goes to cover the fourth flank of the article, and for rotating the fourth folding tab, with respect to the folding line which separates it from the fourth lateral closing wall, so as to fold the fourth folding tab up to superposing the fourth lateral closing wall on a part of the upper face of the article; means for dispensing glue predisposed for applying glue on the second and fourth folding tab folded onto the upper face of the article; blocking means, for blocking and halting the cardboard blank once the means for dispensing glue have applied the glue; third folding organs for rotating the second lateral closing wall so as to fold it with respect to the first portion on which the article is rested up to when it goes to cover the second flank of the article, and fourth folding organs for rotating, in succession, the upper closing wall, and for folding the second lateral closing wall with respect to the second lateral closing wall up to when the second lateral closing wall goes to cover the upper face of the article, and therefore provide at an outlet from the second folding station a cardboard box partially closed with the packed article internally thereof;

a final closing station, situated downstream of the second folding station and to which the partially-closed cardboard box is fed, which is realised as the closing station according to claim 1: for rotating the first lateral closing wall, with respect to the first transversal score line, so as to fold the first lateral closing wall with respect to the first portion on which the article is rested so that the first lateral closing wall goes to cover the first flank of the article; for applying glue on the upper portions of the first lateral closing wall; for rotating the closing tab with respect to the fourth transversal score line, and folding the closing tab with respect to the upper wall against the upper part of the first lateral closing wall on which the glue had been applied, in order to make the closing tab adhere thereto and complete the closing of the cardboard box with the article packed internally thereof, in order to provide at an outlet of the final closing station a cardboard box completely closed with the packed article internal thereof.

* * * * *